US009403359B2

(12) United States Patent
Kato et al.

(10) Patent No.: US 9,403,359 B2
(45) Date of Patent: Aug. 2, 2016

(54) LIQUID EJECTION DEVICE

(71) Applicant: Brother Kogyo Kabushiki Kaisha, Nagoya-shi, Aichi-ken (JP)

(72) Inventors: Yasuhiro Kato, Nagoya (JP); Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/667,257

(22) Filed: Mar. 24, 2015

(65) Prior Publication Data

US 2015/0273823 A1 Oct. 1, 2015

(30) Foreign Application Priority Data

Mar. 28, 2014 (JP) ..... 2014-068153

(51) Int. Cl.
*B41J 2/045* (2006.01)
*B41J 11/00* (2006.01)

(52) U.S. Cl.
CPC ..... *B41J 2/04573* (2013.01); *B41J 2/04556* (2013.01); *B41J 2/04586* (2013.01); *B41J 11/0015* (2013.01)

(58) Field of Classification Search
USPC ..... 347/8
See application file for complete search history.

(56) References Cited

U.S. PATENT DOCUMENTS 5,515,094 A 5/1996 Tanaka et al.
2002/0051025 A1 5/2002 Hinojosa et al.
2003/0132978 A1 7/2003 Hinojosa et al.
2005/0078134 A1* 4/2005 Igarashi ..... B41J 2/04503 347/14
2013/0257937 A1* 10/2013 Arakane ..... B41J 25/001 347/8

FOREIGN PATENT DOCUMENTS

| | | | |
|---|---|---|---|
| EP | 1182041 | A1 | 2/2002 |
| JP | H05-155009 | A | 6/1993 |
| JP | 2868999 | B2 | 3/1999 |
| JP | 2004-017586 | A | 1/2004 |
| JP | 2008230069 | A * | 10/2008 |
| JP | 2009-202430 | A | 9/2009 |
| JP | 2013018137 | A * | 1/2013 |
| JP | 2013-226801 | A | 11/2013 |

OTHER PUBLICATIONS

Machine generated English translation of JP 2008-230069A, "Inkjet Recorder and Method for Controlling Recording Position" to Yasutani et al. Retreived via https://www4.j-platpat.inpit.go.jp/eng/tokujitsu/tkbs_en/TKBS_EN_GM101_Top.action on Sep. 24, 2015; 20 pp.*

* cited by examiner

*Primary Examiner* — Shelby Fidler
(74) *Attorney, Agent, or Firm* — Banner & Witcoff, Ltd.

(57) ABSTRACT

A liquid ejection device includes a liquid ejection head including a surface formed with nozzles arranged in a first direction, a head moving unit reciprocating the liquid ejection head along a line parallel to the surface and perpendicular to the first direction, a conveyor portion conveying the recording medium in the first direction, and a corrugate mechanism disposed upstream or downstream of the liquid ejection head in the first direction and forming the recording medium in a predetermined corrugated shape. A controller determines an ejection timing for ejecting liquid from ones of the nozzles appropriate to a corrugated shape formed in the recording medium while the liquid ejection head is moved, a memory that stores ejection timing information, and a gap sensor that moves with the liquid ejection head to determine a gap between the recording medium and the liquid ejection surface in the second direction.

11 Claims, 9 Drawing Sheets

LIQUID EJECTION DEVICE

CROSS-REFERENCE TO RELATED APPLICATION

This application claims priority from Japanese Patent Application No. 2014-068153, filed on Mar. 28, 2014, the content of which is incorporated herein by reference in its entirety.

TECHNICAL FIELD

Aspects disclosed herein relate to a liquid ejection device that ejects liquid toward a recording medium from nozzles.

BACKGROUND

A known liquid ejection device ejects liquid toward a recording medium from one or more nozzles. Such a liquid ejection device includes an inkjet printer that is configured to perform printing on a recording sheet by ejecting ink from an inkjet head that reciprocates in a scanning direction. Such an inkjet printer includes a plurality of ribs that are arranged side by side along the scanning direction and a plurality of corrugate plates, each of which being located between each pair of ribs of the plurality of ribs. In the inkjet printer, while a recording sheet is conveyed, the plurality of ribs support a recording sheet from below at a position upstream of the inkjet head in a conveyance direction and the plurality of corrugate plates press the recording sheet from above at the same position in conjunction with the plurality of ribs, resulting in formation of a predetermined corrugated shape in the recording sheet along the scanning direction. Under this condition, a gap between the recording sheet and the inkjet head varies along the scanning direction. Therefore, the inkjet printer obtains gap variation information relating to variation in the gap therebetween along the scanning direction prior to performance of printing, and controls timings of ejecting ink to be landed on the recording sheet, from the nozzles, based on the gap variation information.

SUMMARY

In the above inkjet printer, ink may be ejected, at the same ejection timing, from nozzles included in the same row extending along the conveyance direction of the recording sheet. A first portion of the recording sheet, which may be positioned closer to the corrugate plate, may be maintained in a corrugated shape closer to an ideal shape. Nevertheless, it may be difficult to maintain a second portion of the recording sheet, which may be located farther from the corrugate plates, in a corrugated shape closer to the ideal shape. Thus, the corrugated shape formed in the second portion of the recording sheet may differ from the corrugated shape formed in the first portion. That is, a gap between the recording sheet and the inkjet head may vary with respect to the conveyance direction. Therefore, if ink is ejected, at the same ejection timing, from the nozzles included in the same row extending along the conveyance direction of the recording sheet, ink droplets may land on respective positions that may deviate from respective target landing positions.

Accordingly, some illustrative embodiments provide for a liquid ejection device that may reduce landing deviation of ink droplets.

In at least some illustrative embodiments, according to one or more aspects of the disclosure, the plurality of nozzles are arranged along the first direction and are divided into the first nozzle group and the second nozzle group that is aligned with the first nozzle group in the first direction. The ink ejection timing for first nozzle group may be different from the ink ejection timing for second nozzle group. Therefore, even when the gap varies with respect to the first direction, liquid may be ejected from the first nozzle group and the second nozzle group, respectively, at the respective ejection timings appropriate to the gap variation, thereby reducing landing deviation of ink droplets.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
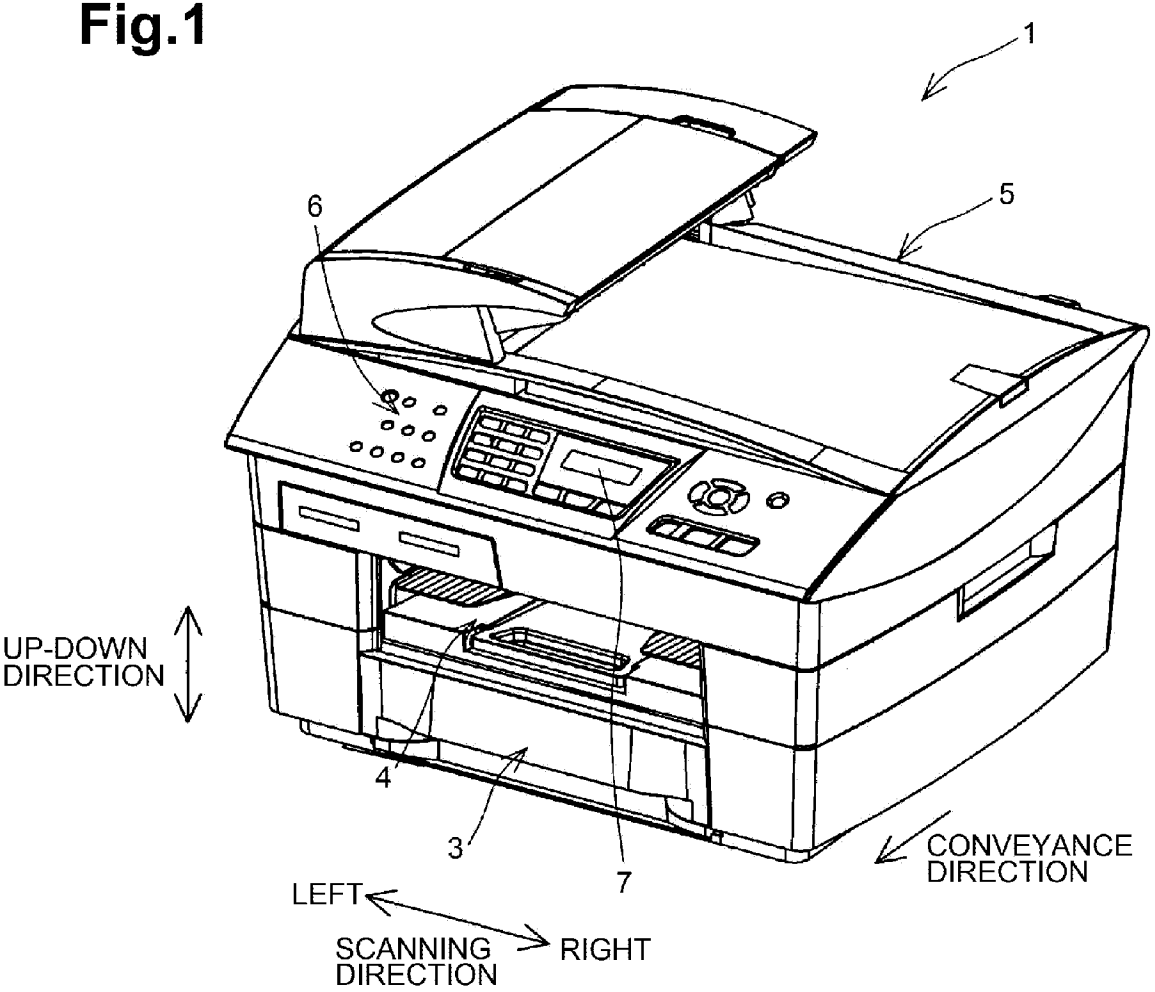
FIG. 1 is a perspective view depicting an inkjet printer in an illustrative embodiment according to one or more aspects of the disclosure.

An illustrative embodiment according to one or more aspects will be described below with reference to the accompanying drawings.

An inkjet printer 1 according to the illustrative embodiment may be a multifunction device that is capable of performing multiple functions, for example, printing on a recording sheet P and reading of an image from a document. The inkjet printer 1 includes a printing unit 2 (see FIG. 2), a sheet feed tray 3, a discharge tray such as a sheet discharge tray 4 (, a reading unit 5, an operation unit 6, and a display unit 7. An operation of the inkjet printer 1 is controlled by a controller 50 (see FIG. 5).

The printing unit 2 is disposed inside the inkjet printer 1 and is configured to perform printing on one or more recording sheets P. A detailed configuration of the printing unit 2 will be described later below. The sheet feed tray 3 is configured to feed one or more recording sheets P subjected to printing performed by the printing unit 2. The sheet discharge tray 4 is a place where one or more recording sheets P on which printing has been performed by the printing unit 2 are discharged. The reading unit 5 may be, for example, a scanner. The reading unit 5 is configured to read an image from a document. The operation unit 6 includes, for example, buttons. A user can perform operations on the inkjet printer 1 by operating one or more of the buttons of the operation unit 6. The display unit 7 may be, for example, a liquid crystal display. The display unit 7 is configured to display information while the inkjet printer 1 is used.

Figure 2:
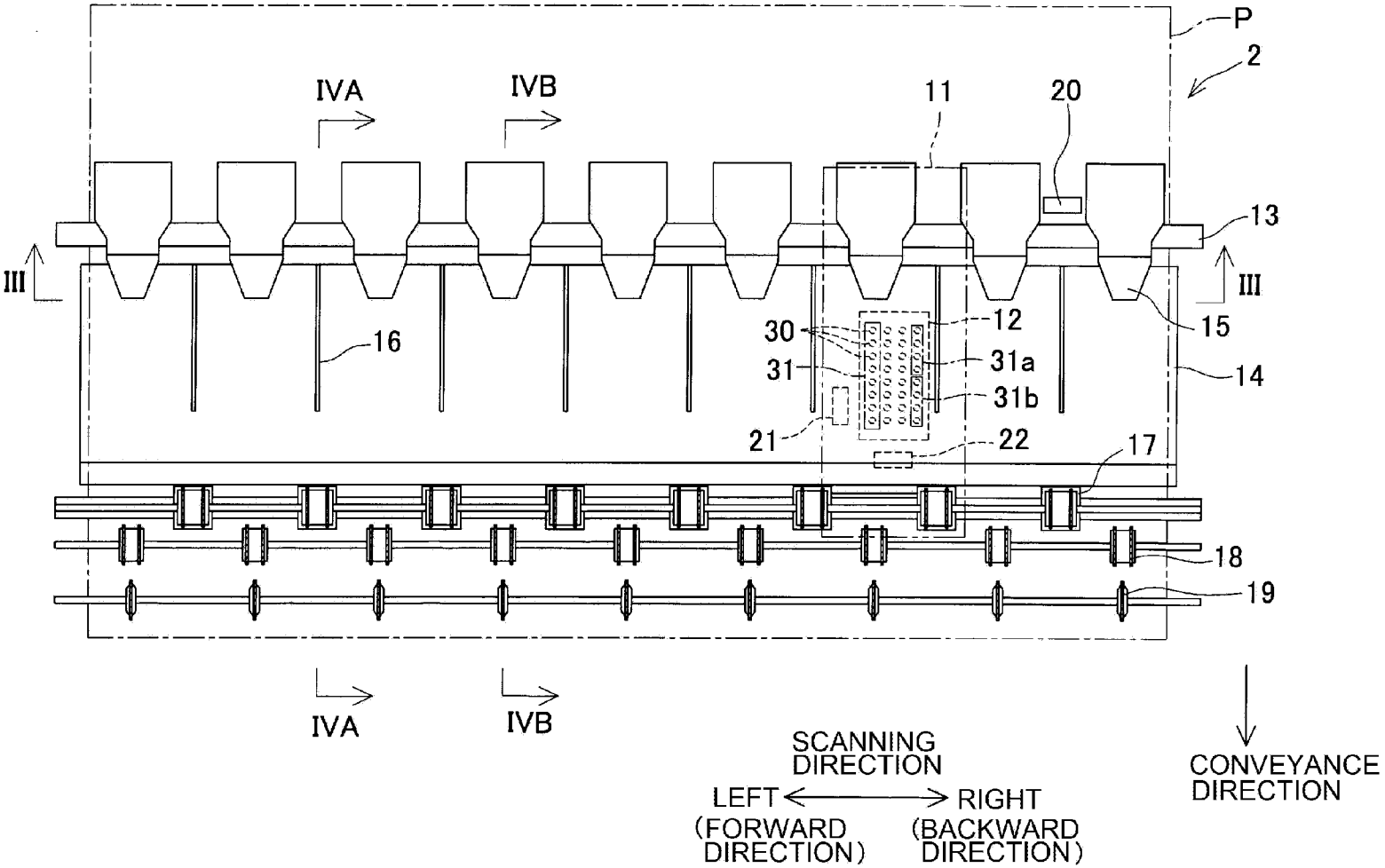
FIG. 2 is a plan view depicting a printing unit of the inkjet printer of FIG. 1 in the illustrative embodiment according to one or more aspects of the disclosure.
Figure 3:
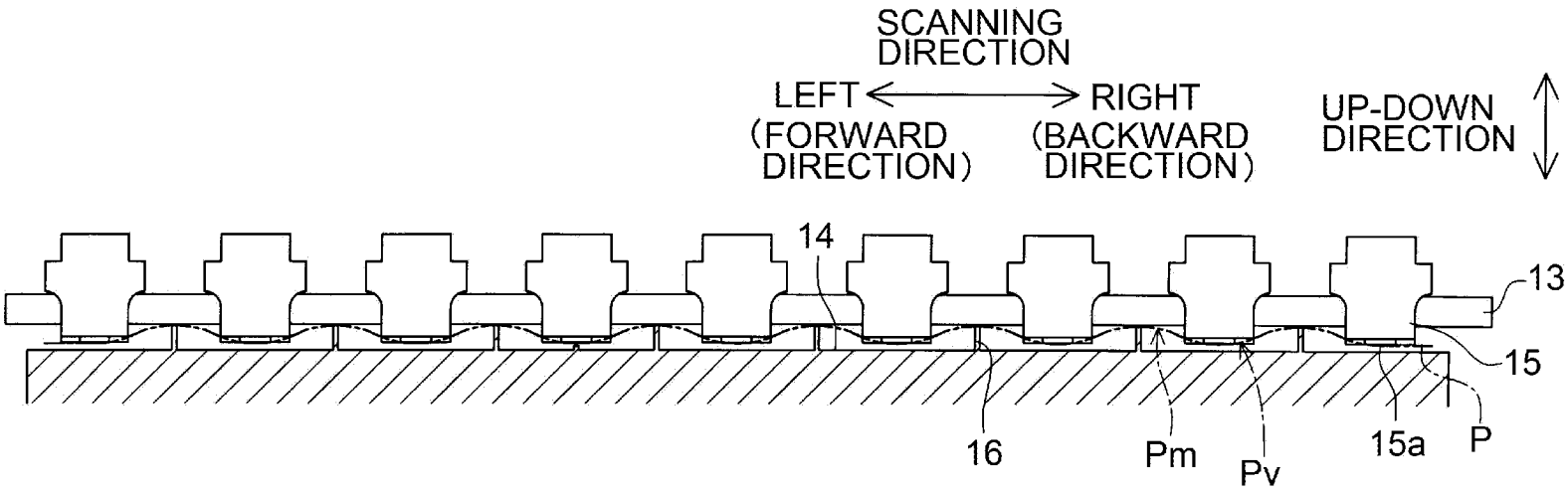
FIG. 3 is a cross sectional view taken along a line III-III of FIG. 2 in the illustrative embodiment according to one or more aspects of the disclosure.
Figure 4A:
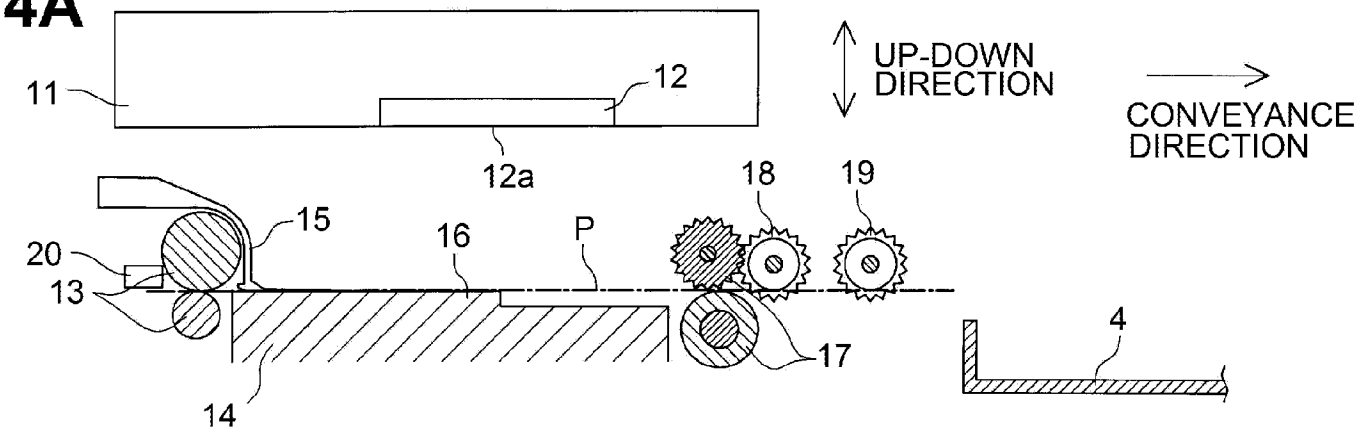
FIG. 4A is a cross sectional view taken along a line IVA-IVA of FIG. 2 in the illustrative embodiment according to one or more aspects of the disclosure.
Figure 4B:
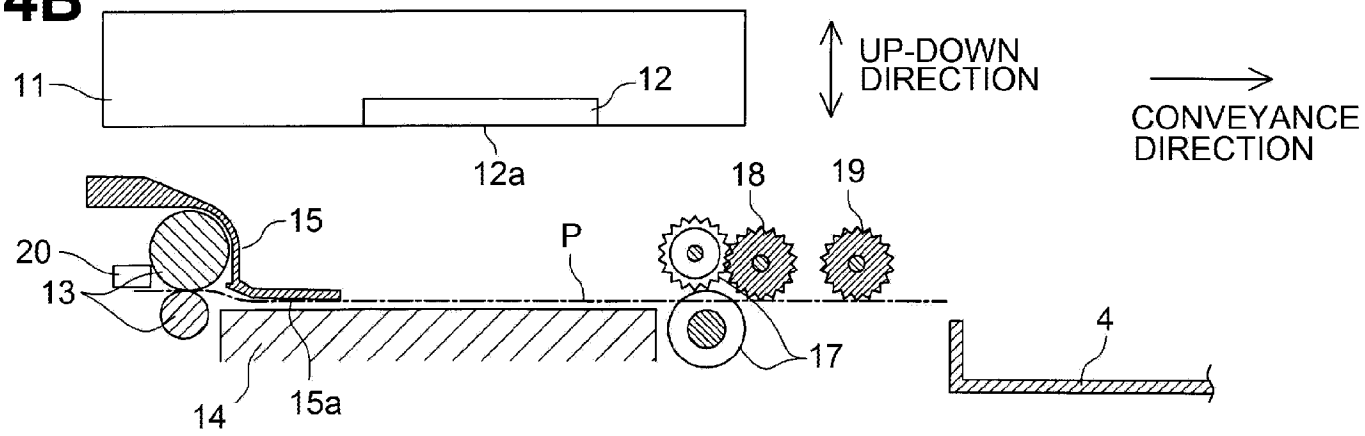
FIG. 4B is a cross sectional view taken along a line IVB-IVB of FIG. 2 in the illustrative embodiment according to one or more aspects of the disclosure.

The printing unit 2 will be further described below. As depicted in FIGS. 2, 3, and 4, the printing unit 2 includes a head moving unit such as carriage 11, a liquid ejection head such as an inkjet head 12 (, a sheet feed roller 13, a platen 14, a plurality of corrugate plates 15, a plurality of ribs 16, a sheet discharge roller 17, a plurality of corrugate spurs 18 and 19, a sheet detector 20, a gap sensor such as a media sensor 21, and an encoder sensor 22. In FIG. 2, for simplicity purposes, the carriage 11 is indicated by a double-dotted and dashed line and a portion below the carriage 11 is indicated by a solid line.

The carriage 11 is configured to reciprocate along a scanning direction (e.g., along a right-left direction) while being guided by, for example, guide rails. The inkjet head 12 is disposed on the carriage 11. The inkjet head 12 is configured to eject ink of, for example, four colors (e.g., black, yellow, cyan, and magenta) from a plurality of nozzles 30 defined in its lower surface, e.g., an ink ejection surface 12*a*. The inkjet head 12 is further configured to move along the right-left direction within a range in which the inkjet head 12 may face a recording sheet P, along with the carriage 11. The position that is defined at the end of the range in the right-left direction is a standby position at which the carriage 11 is kept on standby while the inkjet head 12 is not used. Hereinafter, leftward movement of the inkjet head 12 and the carriage 11 from the standby position in FIG. 2 is referred to as "forward movement of the inkjet head 12" and a direction that the inkjet head 12 moves leftward is referred to as a "forward direction, and rightward movement of the inkjet head 12 and the carriage in FIG. 2 is referred to as "backward movement" of the inkjet head 12 and a direction that the inkjet head 12 moves rightward is referred to as a "backward direction".

The ink ejection surface 12*a* includes a plurality of nozzle rows 31 arranged side by side in the scanning direction. Each of the nozzle rows 31 includes some of the plurality of nozzles 30 arranged in a line along a conveyance direction. The some nozzles 30 in the same nozzle row 31 eject ink of the same color. As depicted in FIG. 2, there are, for example, four nozzle rows 31 provided in the illustrative embodiment. Nevertheless, in other embodiments, for example, two or more nozzle rows 31 may be provided for each color of ink. In FIG. 2, the plurality of nozzles 30 are arranged in a grid pattern. Nevertheless, in other embodiments, for example, the plurality of nozzles 30 may be arranged in a staggered pattern. The inkjet head 12 includes an actuator (not depicted) for applying ejection energy on ink stored in each of the plurality of nozzles 30. For example, a piezoelectric-type actuator may be adopted. With such an actuator, distortion caused in a piezoelectric layer by application of voltage on the piezoelectric layer may be used for ink ejection. Nevertheless, the configuration of the actuator is not limited to the above example. The inkjet head 12 applies ejection energy to ink stored in each of the plurality of nozzles 30 using the actuator to eject ink from the respective nozzles 30 individually.

The sheet feed roller 13 includes a pair of rollers and is configured to pinch and convey a recording sheet P fed from the sheet feed tray 3 in the conveyance direction perpendicular to the scanning direction. The platen 14 is disposed facing the ink ejection surface 12*a*. The recording sheet P conveyed by the sheet feed roller 13 is conveyed along an upper surface of the platen 14.

The corrugate plates 15 are disposed facing an upstream end portion of the upper surface of the platen 14 (e.g., at a position opposite to the sheet discharge tray 4) in the conveyance direction. The corrugate plates 15 are spaced apart from each other at substantially regular intervals in the scanning direction. While the recording sheet P is conveyed by the sheet feed roller 13 and passes between the platen 14 and the corrugate plates 15, the corrugate plates 15 press the recording sheet P from above by their lower surfaces, e.g., pressing surfaces 15*a*.

Each of the ribs 16 is disposed on the upper surface of the platen 14 and between each of the corrugate plates 15 with respect to the scanning direction. The ribs 16 are spaced apart from each other at substantially regular intervals in the scanning direction. The plurality of ribs 16 protrude upward from the upper surface of the platen 14 and upper edges of the plurality of ribs 16 are located higher than the pressing surfaces 15*a* of the corrugate plates 15. The plurality of ribs 16 extend from an upstream end of the platen 14 along the conveyance direction. While the recording sheet P is conveyed along the platen 14, the recording sheet P is supported by the plurality of ribs 16 from below.

The sheet discharge roller 17 includes a plurality of pairs of rollers and is disposed downstream of the inkjet head 12 in the conveyance direction. Each of the plurality of pairs of rollers of the sheet discharge roller 17 is disposed at the same position as a corresponding one of the plurality of ribs 16 is disposed with respect to the scanning direction. That is, the sheet discharge roller 17 is configured to pinch and convey the recording sheet P using the pairs of rollers toward the sheet discharge tray 4 along the conveyance direction. In the sheet discharge roller 17, upper rollers of the plurality of pairs of rollers have a spur shape for reducing adhesion of ink thereto from the recording sheet P. In the illustrative embodiment, the sheet feed roller 13 and the sheet discharge roller 17 may be an example of a conveyor portion.

The plurality of corrugate spurs 18 are disposed downstream of the sheet discharge roller 17 in the conveyance direction and at substantially the same positions as the corrugate plates 15, respectively, with respect to the scanning direction. The plurality of corrugate spurs 19 are disposed downstream of the plurality of corrugate spurs 18 in the conveyance direction and at substantially the same positions as the plurality of corrugate plates 15, respectively, with respect to the scanning direction. Lower ends of the plurality of corrugate spurs 18 and 19 are located at respective positions lower than the pinching positions at which the pairs of rollers of the sheet discharge roller 17 pinch the recording sheet P, in an up-down direction. This configuration enables the plurality of corrugate spurs 18 and 19 to press the recording sheet P from above at the respective positions. Since the plurality of corrugate spurs 18 and 19 might not be a roller having a flat peripheral surface, adhesion of ink thereto from the recording sheet P may be reduced.

While the recording sheet P is conveyed along the platen 14, the recording sheet P is pressed from above by the plurality of corrugate plates 15 and the plurality of corrugate spurs 18 and 19 and is supported from below by the plurality of ribs 16, whereby the recording sheet P is formed into a corrugated shape. More specifically, a portion of the recording sheet P pressed by the plurality of corrugate plates 15 is formed into a corrugated shape in which the recording sheet P has alternating ridge portions Pm and groove portions Pv along the scanning direction as depicted in FIG. 3. The ridge portions Pm protrude upward (e.g., toward the ink ejection surface 12*a*) and the groove portions Pv protrude downward (e.g., toward the upper surface of the platen 14). Portions of the plurality of ribs 16 (hereinafter, referred to as "overlapping portions" of the plurality of ribs 16) are located at the same position in the conveyance direction as the pressing surfaces 15*a* of the plurality of corrugate plates 15. Thus, the plurality of corrugate plates 15 and the overlapping portions of the ribs 16 are configured to form a predetermined corrugated shape in the recording sheet P. The other portions of the plurality of ribs 16 and the plurality of corrugate spurs 18 and 19 are configured to maintain the recording sheet P in the corrugated shape. Lower ends of the plurality of corrugate spurs 18 and 19 are located at respective positions slightly higher than the pressing surfaces 15*a* of the corrugate plates 15. With this configuration, pressing forces of the corrugate spurs 18 and 19 that press a recording sheet P are weaker than pressing forces of the corrugate plates 15 that press the recording sheet P. The corrugate plates 15 and the overlapping portions of the ribs 16 may be an example of a corrugate mechanism.

The sheet detector 20 is disposed upstream of the sheet feed roller 13 in the conveyance direction. The sheet detector 20 is configured to detect presence or absence of a recording sheet P. The sheet detector 20 may include, for example, an optical sensor. The sheet detector 20 is configured to output a detection signal to the controller 50.

The media sensor 21 is disposed on the carriage 11 and to the left of the inkjet head 12 in the scanning direction. The media sensor 21 is disposed at substantially the same position, with respect to the scanning direction, as downstream ones of the plurality of nozzles 30 in the nozzle rows 31 (hereinafter, referred to as "second nozzle groups 31*b*") in the conveyance direction. The media sensor 21 is configured to detect positions of edges of a recording sheet P with respect to the scanning direction and to determine a distance between a fixed reference point, which is defined on the ink ejection surface 12*a*, and each point, which is defined on a surface of a recording sheet P in the scanning direction and may be opposite to the fixed reference point in the up-down direction while the inkjet head 12 moves in the scanning direction. Hereinafter, the distance therebetween is referred to as "gap in the scanning direction").

The media sensor 21 includes a light-emitting device and a light-receiving device. The light-emitting device is configured to emit light toward the platen 14. The light-receiving device is configured to receive light that is emitted by the light-emitting device and is reflected off the platen 14 or the recording sheet P on the platen 14. The upper surface of the platen 14 has a black color and has V-shaped grooves (not depicted) therein which extend in the conveyance direction. When a recording sheet P is positioned on the platen 14, light emitted by the light-emitting device is reflected off the recording sheet P and is received by the light-receiving device. When a recording sheet P is absent on the platen 14, light emitted by the light-emitting device is reflected off inner walls of the grooves defined in the upper surface of the platen 14 diffusely. Light reflected via diffuse reflection may or might not be received by the light-receiving device. Thus, an amount of light incident upon the light-receiving device when a recording sheet P is absent on the platen 14 is less than an amount of light incident upon the light-receiving device when a recording sheet P is positioned on the platen 14. The media sensor 21 is configured to output, to the controller 50, a signal (e.g., a gap detection signal) relating to the amount of light received by the light-receiving device.

The encoder sensor 22 is disposed on the carriage 11. The encoder sensor 22 is configured to detect a position of the inkjet head 12. The encoder sensor 22 includes an encoder strip (not depicted) that extends along the scanning direction. The encoder sensor 22 and the encoder strip constitute a linear encoder. The encoder sensor 22 is configured to detect slits formed in the encoder strip in the scanning direction. The encoder sensor 22 is further configured to output a signal to the controller 50.

In the printing unit 2 having the above-described configuration, printing is performed on a recording sheet P by ejecting ink from the inkjet head 12 that reciprocates along with the carriage 11 in the scanning direction while the sheet feed roller 13 and the sheet discharge roller 17 convey the recording sheet P in the conveyance direction.

Figure 5:
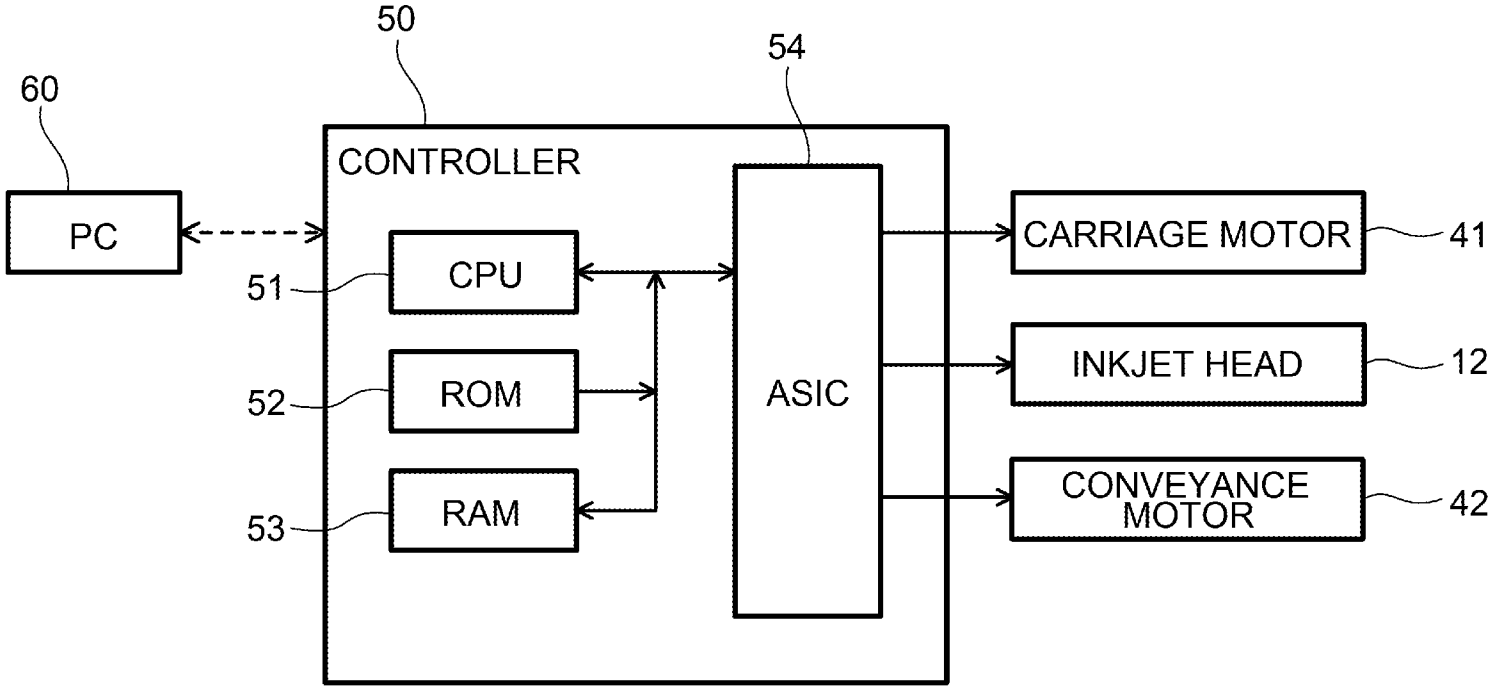
FIG. 5 is a schematic block diagram depicting an electrical configuration of the inkjet printer of FIG. 1.

Hereinafter, the controller 50 for controlling the operation of the inkjet printer 1 will be described. As depicted in FIG. 5, the controller 50 includes a central processing unit ("CPU") 51, a read-only memory ("ROM") 52, a random-access memory ("RAM") 53, and an application specific integrated circuit ("ASIC") 54 including various control circuits. The controller 50 is connected to an external device, e.g., a personal computer ("PC") 60, and is configured to perform communication of data with the PC 60.

The controller 50 allows the CPU 51 and/or the ASIC 54 to perform various processes in accordance with data and/or programs stored in the RAM 53 and/or the ROM 52. For example, the controller 50 controls a carriage motor 41 for driving the carriage 11 and a conveyance motor 42 for driving the inkjet head 12 and rotating the rollers 13 and 17 to perform printing of an image on a recording sheet P, in response to a printing instruction provided through one of the PC 60 and the operation unit 6. Each of the CPU 51 and the ASIC 54 may be an example of a control device. In the illustrative embodiment, the controller 50 performs the various processes by the CPU 51 and/or the ASIC 54, for example. Nevertheless, the aspects of the disclosure are not limited to the above example. For example, in other embodiments, the controller 50 may be implemented by any hardware configuration. In one example, the processes may be performed by only one of the CPU 51 and the ASIC 54. In another example, the controller 50 may be implemented by which functions may be shared among two or more CPUs 51 and/or two or more ASICs 54.

A sheet information signal that represents a paper type of a recording sheet P to be used, e.g., plain paper, glossy paper, or matte paper, is provided to the controller 50 from one of the PC 60 and the operation unit 6. In other embodiments, for example, the inkjet printer 1 may include a sensor for detecting the paper type of a recording sheet P, and the sensor may be configured to output, to the controller 50, a sheet information signal that represents the paper type of the recording sheet P.

The controller 50 determines a position of a recording sheet P with respect to the conveyance direction based on signals outputted from the sheet detector 20. More specifically, the controller 50 determines a position of a leading edge of a recording sheet P based on an amount of the recording sheet P conveyed by the sheet feed roller 13 and the sheet discharge roller 17 from the moment of detection of the presence of the recording sheet P until a particular moment. The controller 50 further determines a position of a trailing edge of the recording sheet P based on an amount of the recording sheet P conveyed by the sheet feed roller 13 and the sheet discharge roller 17 from the moment of detection of the absence of the recording sheet P until a particular moment. The controller 50 also determines the position of the inkjet head 12 at all times based on signals transmitted from the encoder sensor 22. The controller 50 further determines the gap in the scanning direction as well as respective positions of edges of the recording sheet P with respect to the scanning direction, based on signals outputted by the media sensor 21.

In the illustrative embodiment, the inkjet printer 1 is configured to perform printing by ejecting ink from the plurality of nozzles 30 during both the forward and backward movements of the inkjet head 12 (e.g., bidirectional printing). The inkjet printer 1 is configured to convey a recording sheet P along the conveyance direction by a predetermined conveyance amount and eject ink from the plurality of nozzles 30 while the inkjet head 12 is moved in one of the forward direction and the backward direction. The inkjet printer 1 performs the sheet conveyance and the ink ejection alternately to perform printing on a recording sheet P. The ink ejection from the plurality of nozzles 30 performed while the inkjet head 12 is moved in one of the forward direction and the backward direction is referred to as "one-pass printing". The total number of one-pass printing performed on a recording sheet P is determined in accordance with the length of an area to be printed of the recording sheet P in the conveyance direction.

In the illustrative embodiment, the inkjet printer 1 is configured to selectively perform one of interlaced printing and non-interlaced printing. In interlaced printing, a plurality of dots are formed on a first portion of a recording sheet by one-pass printing. In the next one-pass printing, a plurality of dots are formed on a second portion that partially overlaps the first portion on which printing has been performed in the previous one-pass printing, i.e., the plurality of dots are formed in spaces left between the dots formed in the conveyance direction in the preceding one-pass printing. In the non-interlaced printing, a plurality of dots are formed on a first portion of a recording sheet by one-pass printing. In the next one-pass printing, a plurality of dots are formed on second portion that does not overlap the first portion on which printing has been performed in the previous one-pass printing, i.e., the plurality of dots are formed at respective positions in the second portion downstream of the first portion in the conveyance direction. Therefore, an amount of a recording sheet conveyed between one-pass printing in non-interlaced printing is greater than an amount of a recording sheet conveyed between one-pass printing in interlaced printing. That is, interlaced printing is for printing at high resolution, and non-interlaced printing is for printing at high speed.

In the interlaced printing and the non-interlaced printing, first one-pass printing is performed while the inkjet head 12 moves in the forward direction from the standby position. In interlaced printing, there may be a case in which one-pass printing is performed a plurality of times after a trailing edge of the recording sheet P in the conveyance direction passes the corrugate plates 15. In contrast, in non-interlaced printing, after a trailing edge of the recording sheet P in the conveyance direction passes the corrugate plates 15, one-pass printing is performed once at maximum (i.e., the last one-pass printing is performed) before non-interlaced printing is completed.

In a case where interlaced printing is performed, the light-receiving device of the media sensor 21 may receive light reflected off a surface of the recording sheet P to which ink adheres Reflectivity is different between a surface having ink thereon and a surface having no ink thereon in a recording sheet P. Therefore, an amount of light reflected off the recording sheet P is also different between the surface having ink thereon and the surface having no ink thereon. Thus, in the illustrative embodiment, the controller 50 is configured to determine the gap in the scanning direction by correcting information based on signals outputted from the media sensor 21, in accordance with an amount of ink ejection from the nozzles 30.

Figure 6A:
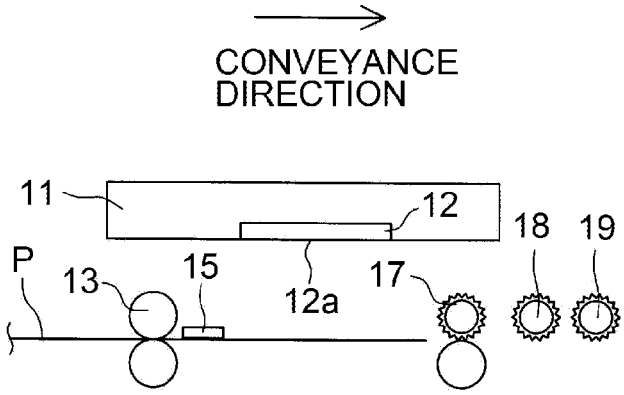
FIGS. 6A, 6B, and 6C schematically illustrate change in a position of a recording sheet with respect to a conveyance direction in the illustrative embodiment according to one or more aspects of the disclosure.
Figure 6B:
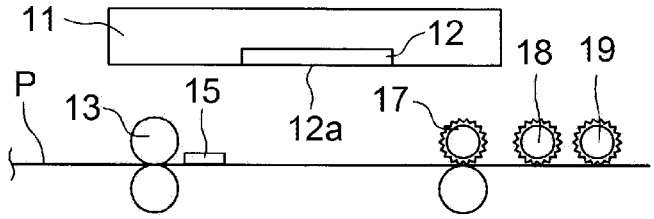
Figure 6C:
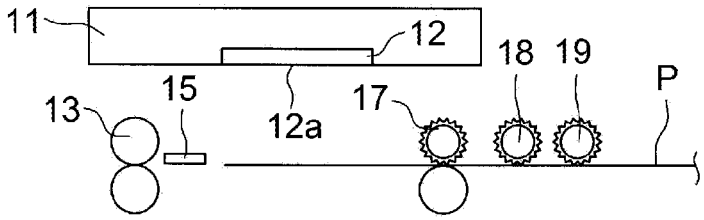

FIG. 6A is a schematic diagram depicting a state in which a leading edge of a recording sheet P in the conveyance direction is positioned upstream of the sheet discharge roller 17 and downstream of the corrugate plates 15 in the conveyance direction. FIG. 6B is a schematic diagram depicting a state in which the leading edge of the recording sheet P in the conveyance direction is positioned downstream of the sheet discharge roller 17 in the conveyance direction and a trailing edge of the recording sheet P in the conveyance direction is positioned upstream of the corrugate plates 15 in the conveyance direction. FIG. 6C is a schematic diagram depicting a state in which the trailing edge of the recording sheet P in the conveyance direction is positioned downstream of the corrugate plates 15 and upstream of the sheet discharge roller 17 in the conveyance direction.

While a recording sheet P is conveyed in the conveyance direction, a particular area of a recording sheet P may face the ink ejection surface 12*a*. In a case where a recording sheet having relatively lower stiffness (e.g., plain paper) is used as a recording sheet P, in a state where the recording sheet P is pressed by the corrugate plates 15 from above as depicted in FIGS. 6A and 6B, a portion relatively closer to the corrugate plates 15 in the particular area of the recording sheet P is maintained in a corrugated shape that is nearly an ideal shape depicted in FIG. 3. When a plurality of recording sheets P are conveyed successively and printing is performed thereon, substantially the same corrugated shape (e.g., the nearly ideal shape) may always be formed in a portion relatively closer to the corrugate plate 15 in the particular area of each of the recording sheets P while one of the recording sheets P is pressed by the corrugate plates 15. Nevertheless, since the pressing forces of the pairs of rollers of the discharge roller 17 are weaker than the pressing forces of the corrugate spurs 18 and 19, a portion relatively far from the corrugate plates 15 in the particular area of the recording sheet P may be formed in a corrugated shape that is different from the ideal shape depicted in FIG. 3. The corrugated shape formed in the portion relatively far from the corrugate plates 15 in the particular area of the recording sheet P may change while the recording sheet P is conveyed in the conveyance direction. When a plurality of recording sheets P are conveyed successively and printing is performed thereon, substantially the same corrugated shape might not always be formed in the portion relatively far from the corrugate plates 15 in the particular area of each of the recording sheets P while one of the recording sheets P is pressed by the corrugate plates 15.

In a case where a recording sheet having relatively higher stiffness, e.g., glossy paper, is used as a recording sheet P, the recording sheet P is formed into a corrugated shape that may be more gentle (i.e., have a smaller amplitude) than the corrugated shape of the plain paper even when the recording sheet P is pressed by the corrugate plates 15 from above as depicted in FIGS. 6A and 6B. Therefore, the recording sheet P may have a corrugated shape that has a smaller amplitude than the corrugated shape of the plain paper depicted in FIG. 3, in a portion relatively closer to the corrugate plates 15 in the particular area of the recording sheet P. The recording sheet P may have a substantially flat shape (or a slight corrugated shape) in a portion relatively far from the corrugate plates 15 in the particular area of the recording sheet P. That is, substantially the same shape may be formed in both the portion closer to the corrugate plates 15 and the portion farther from the corrugate plates 15 in the particular area of the recording sheet P.

Regardless of the paper type of the recording sheet P, as depicted in FIG. 6C, as a trailing edge of the recording sheet P in the conveyance direction passes the corrugate plates 15, the corrugated shape formed in the recording sheet P may change greatly and substantially the same shape might not be ensured in the particular area of the recording sheet P. After the trailing edge of the recording sheet P in the conveyance direction passes the corrugate plates 15, the recording sheet P is pinched by the sheet discharge roller 17 and pressed by the corrugate spurs 18 and 19 from above. Therefore, the corrugated shape of the recording sheet P on the platen 14 changes with respect to the conveyance direction.

Figure 7:
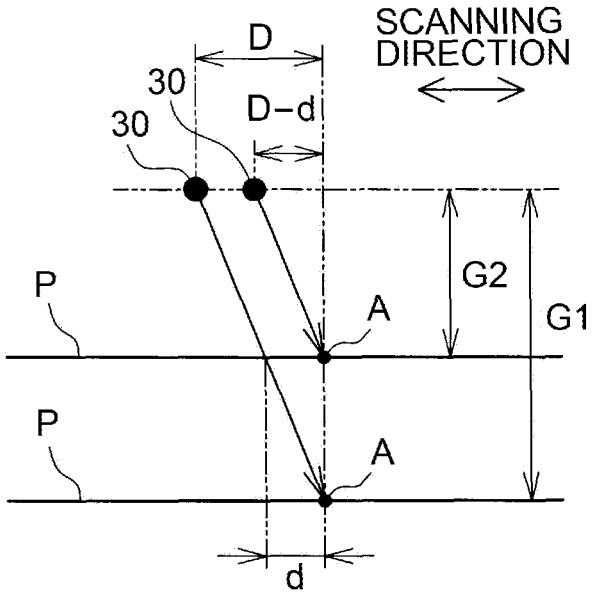
FIG. 7 illustrates a relationship between a gap between a particular nozzle and a recording sheet and a timing of ejecting ink from the nozzle in the illustrative embodiment according to one or more aspects of the disclosure.

As depicted in FIG. 7, assuming that in a case where the gap in the scanning direction has a distance G1, an ink droplet lands on a target position A when ink ejection is performed at the time a nozzle 30 is located at a position that is shifted from the target position A in the scanning direction by distance D. On this precondition, in a case where the gap in the scanning direction has a distance G2 that is smaller than the distance G1, an ink droplet lands on a position that is shifted from the target position A in the scanning direction by distance d when ink ejection is performed at the time the nozzle 30 is located at a position that is shifted from the target position A in the scanning direction by distance D. Therefore, in order to land an ink droplet on the target position A when the gap in the scanning direction has the distance G2, ink needs to be ejected when the nozzle 30 is located at a position that is shifted from the target position A by distance D-d. That is, when the gap in the scanning direction has the distance G2, a timing at which ink is ejected from the nozzle 30 needs to be delayed as compared with the timing when the gap in the scanning direction has the distance G1.

As described above, while the recording sheet P is conveyed along the platen 14, the recording sheet P is formed in a corrugated shape along the scanning direction. Therefore, the gap in the scanning direction, i.e., the distance between the fixed reference point of the ink ejection surface 12*a* and each point of a surface of a recording sheet, varies with respect to a width direction of the recording sheet P (e.g., the scanning direction). Thus, in the inkjet printer 1 according to the illustrative embodiment, timings at which ink is ejected from the respective ink nozzle rows 31 are differentiated therebetween in accordance with the variation in the gap in the scanning direction in the recording sheet P with respect to the scanning direction.

As described above, the corrugated shape of the recording sheet P on the platen 14 may change with distance from the corrugate plates 15 along the conveyance direction. Therefore, a distance between a fixed reference point, which is defined on the ink ejection surface 12*a*, and each point, which is defined on a surface of a recording sheet P in the conveyance direction and may be opposite to the fixed reference point in the up-down direction (hereinafter, referred to as "gap in the conveyance direction") may also vary with respect to the conveyance direction. In this illustrative embodiment, substantially half of the nozzles 30 defined in an upstream half portion of the inkjet head 12 in each of the nozzle rows 31 in the conveyance direction (e.g., nozzles 30 defined in a portion relatively closer to the corrugate plates 15) is referred to as "first nozzle group 31*a*". The remainder of the nozzles 30 in each of the nozzle rows 31 is referred to as a "second nozzle group 31*b*". Thus, in the inkjet printer 1 according to the illustrative embodiment, ink ejection timing for first nozzle group 31*a* and ink ejection timing for second nozzle group 31*b* are differentiated therebetween.

As described above, different corrugated shapes may be formed in recording sheets P of different paper types and a corrugated shape formed in a recording sheet P may change depending on the position of the recording sheet P in the conveyance direction (e.g., whether a trailing edge of the recording sheet P in the conveyance direction has passed the corrugate plates 15) while the recording sheet P is conveyed along the platen 14. Therefore, the gap in the conveyance direction may also vary. Thus, in the inkjet printer 1 according to the illustrative embodiment, a detail of a printing process including an ink-ejection-timing determination process is changed in accordance with the paper type of the recording sheet P and the position of the recording sheet P in the conveyance direction.

Hereinafter, a procedure for performing printing when an ink ejection timing for the first nozzle group 31*a* and an ink ejection timing for the second nozzle group 31*b* are determined in the inkjet printer 1 will be described. Data to be used for determining the ink ejection timings that is prestored in one of the ROM 52 and the RAM 53 of the controller 50 during a manufacturing stage of the inkjet printer 1 will be described below.

A reference ejection timing is prestored in one of the ROM 52 and the RAM 53 of the controller 50. The reference ejection timing indicates an ejection timing when the gap in the scanning direction has a predetermined value (hereinafter, referred to as "reference gap"). The reference gap has a value that is greater than an actual gap. The reference gap may be, for example, a distance between a point, which is defined on a bottom of a groove portion in an ideally corrugated shape, and a fixed reference point, which is defined on the ink ejection surface 12*a*. The reference ejection timing may vary depending on a moving speed and an ink ejection speed of the inkjet head 12. Storing the reference ejection timing may include storing data and a program for calculating the reference ejection timing in accordance with the above conditions.

Information of gap variation in an entire width area of a recording sheet P having a corrugated shape, for example, under the condition of FIG. 6B (hereinafter, referred to as "factory gap variation information") is also prestored in one of the ROM 52 and the RAM 53 of the controller 50, for each paper type to be used as a recording sheet P and/or a paper size of a recording sheet to be used. For example, for a recording sheet P having relatively lower stiffness, e.g., plain paper, factory gap variation information is prestored, for each paper size, e.g., A4-size, A3-size, and B3-size, of a recording sheet P, in one of the ROM 52 and the RAM 53 of the controller 50. Factory gap variation information indicates the gap in the scanning direction in an area, which may be opposite to the first nozzle groups 31*a*, of the recording sheet P of each size. For a recording sheet P having relatively higher stiffness, e.g., glossy paper and matte paper, factory gap variation information is prestored, for each paper type, in one of the ROM 52 and the RAM 53 of the controller 50. In this case, for each paper size, two pieces of factory gap variation information are prestored: one is factory gap variation information that indicates the gap in the scanning direction in an area, which may be opposite to the first nozzle groups 31*a*, of the recording sheet P, and the other is factory gap variation information that indicates the gap in the scanning direction in another area, which may be opposite to the second nozzle groups 31*a*, of the recording sheet P. The factory gap variation information is stored in the controller 50 during the manufacturing stage of the inkjet printer 1. The factory gap variation information may be changed during maintenance after the inkjet printer 1 is shipped.

Information relating to the ink ejection timing for first nozzle group 31*a* and the ink ejection timing for second nozzle group 31*b* appropriate to the factory gap variation information (e.g., delay from the reference ejection timing) are further prestored in one of the ROM 52 and the RAM 53 of the controller 50. Hereinafter, the delay is referred to as a factory correction value. Each of the factory correction value and the factory gap variation information may be an example of "gap information prestored in a memory", and each of the ROM 52 and the RAM 53 may be an example of the "memory". Similar to the factory gap variation information, the factory correction value is provided for each paper type or each paper size and for each nozzle group. The factory correction value varies in accordance with the moving speed and the ink ejection speed of the inkjet head 12 similar to the reference ejection timing. Storing the factory correction value may include storing data and a program for calculating a factory correction value in accordance with the above conditions.

A correction value is also prestored in one of the ROM 52 and the RAM 53 of the controller 50. The correction value (hereinafter, referred to as a "gap correction value") is provided for calculating a gap variation in the conveyance direction in an area, which may be opposite to the first nozzle groups 31*a*, of a recording sheet P based on a gap variation in the conveyance direction in another area, which may be opposite to the second nozzle groups 31*b*, of the recording sheet P when the recording sheet P is in the condition depicted in FIG. 6C.

In the inkjet printer 1 according to the illustrative embodiment, as depicted in FIGS. 6A and 6B, until the trailing edge of the recording sheet P in the conveyance direction passes the corrugate plates 15, printing is performed on the recording sheet P by ejecting ink from appropriate nozzles 30 during both the forward and backward movements of the inkjet head 12. As depicted in FIG. 6C, after the trailing edge of the recording sheet P in the conveyance direction passes the corrugate plates 15, printing is performed on the recording sheet P by ejecting ink from appropriate nozzles 30 during the forward movement of the inkjet head 12 only.

As described above, in non-interlaced printing, after a trailing edge of a recording sheet P in the conveyance direction passes the corrugate plates 15, one-pass printing is performed once at maximum (i.e., the last one-pass printing is performed). Therefore, in a case where a trailing edge of a recording sheet P in the conveyance direction has passed the corrugate plates 15 after one-pass printing immediately prior to the last one-pass printing (hereinafter, also referred to as "second last one-pass printing) was performed and the moving direction of the inkjet head 12 in the second last one-pass printing is the forward direction, the inkjet head 12 is moved in the backward direction without ejecting ink from any nozzles 30 after the second last one-pass printing is completed, and then the last one-pass printing is performed while the inkjet head 12 is moved in the forward direction. When the moving direction of the inkjet head 12 in the second last one-pass printing immediately is the backward direction, the last one-pass printing is performed while the inkjet head 12 is moved in the forward direction immediately after the second last one-pass printing is performed.

A manner of determining ink ejection timing for first nozzle group 31*a* and ink ejection timing for second nozzle group 31*b* when a recording sheet having relatively lower stiffness, e.g., plain paper, is used as a recording sheet P will be described below. Table 1 shows example ink ejection timings for first nozzle group 31*a* and example ink ejection timings for second nozzle group 31*b* in this situation.

TABLE 1

| | | | First nozzle group | Second nozzle group |
|---|---|---|---|---|
| Plain paper | Before passing corrugate plates | During forward movement | Factory correction value for first nozzle group | Real-time correction value |
| | | During backward movement | | Real-time correction value for backward movement |
| | After passing corrugate plates | During forward movement | Real-time correction value (Corrected) | Real-time correction value |
| | | During backward movement | Printing not performed | |

(1) Before Trailing Edge of Recording Sheet P Passes Corrugate Plates 15

The ink ejection timing for first nozzle group 31*a* before a trailing edge of a recording sheet P in the conveyance direction passes the corrugate plates 15 is determined as the factory correction value for first nozzle group 31*a* that is prestored in the controller 50, regardless of the moving direction of the inkjet head 12.

The manner of determining the ink ejection timing for second nozzle group 31*b* is different between a case where the inkjet head 12 moves in the forward direction and a case where the inkjet head 12 is moved in the backward direction. While the inkjet head 12 is moved in the forward direction, the ink ejection timing for second nozzle group 31*b* is determined based on gap detection signals outputted from the media sensor 21 during the forward movement of the inkjet head 12. The controller 50 determines a gap in the scanning direction based on the gap detection signals outputted from the media sensor 21 and calculates the ink ejection timing for second nozzle group 31*b* (e.g., delay from the reference ejection timing) based on the determined gap. Hereinafter, the delay from the reference ejection timing determined by the controller 50 based on the signals outputted from the media sensor 21, is referred to as a "real-time correction value". A real-time correction value for the entire width area of the recording sheet P calculated during the forward movement of the inkjet head 12 is temporarily stored in the RAM 53 of the controller 50.

The real-time correction value is calculated by correcting the factory correction value based on a difference between the gap in the scanning direction based on the factory gap variation information prestored in the controller 50 and an actual gap determined based on the signals outputted from the media sensor 21. In other embodiments, for example, the real-time correction value may be calculated based on a difference between the reference gap stored in the controller 50 and the actual gap determined by the controller 50 based on the signals outputted from the media sensor 21, and the reference ejection timing. In this case, the controller 50 might not necessarily store the factory gap variation information therein.

In a case where the inkjet head 12 is moved in the backward direction, the ink ejection timing for second nozzle group 31*b* is determined based on the real-time correction value for an entire width area of a recording sheet P that is determined by the controller 50 and stored in the RAM 53 during the forward movement of the inkjet head 12. That is, the ink ejection timing for second nozzle group 31*b* during the backward movement of the inkjet head 12 is determined based on the gap detection signal outputted from the media sensor 21 during the forward movement of the inkjet head 12 performed immediately prior to the backward movement of the inkjet head 12.

Printing is performed on a recording sheet P by ejecting ink from the first nozzle group 31*a* and the second nozzle group 31*b*, respectively, at the respective ink ejection timings determined as described above. As described above, before the trailing edge of the recording sheet P passes the corrugate plates 15, the corrugated shape of the recording sheet P conveyed along the platen 14 changes with respect to the conveyance direction. In the illustrative embodiment, the first nozzle group 31*a* and the second nozzle group 31*b* located at the position farther from the corrugate plates 15 than the first nozzle group 31*a* eject ink therefrom at the different ejection timings, respectively. With this control, ink may be ejected from the respective first and second nozzle groups 31*a* and 31*b* at the respective ink ejection timings appropriate to the variation in the gap in the conveyance direction, whereby printing accuracy may be improved.

The ink ejection timing for first nozzle group 31*a*, which is a timing of ejecting ink to land an ink droplet onto a portion of a recording sheet P relatively closer to the corrugate plates 15, is determined as the factory correction value prestored in the controller 50. As described above, substantially the same corrugated shape may always be formed in the portion of the recording sheet P closer to the corrugate plates 15. Therefore, higher printing accuracy may be maintained even when the factory correction value is used as the ink ejection timing for first nozzle group 31*a*. Use of the factory correction value may enable use of the ROM 52 or the RAM 53 with less capacity.

Since the plain paper has relatively lower stiffness, substantially the same corrugated shape might not always be formed in the portion of each plain paper closer to the corrugate plates 15 every time. In the illustrative embodiment, therefore, the ink ejection timing for second nozzle group 31*b*, which is a timing of ejecting ink to land an ink droplet onto a portion of a recording sheet P relatively far from the corrugate plates 15 is determined as the real-time correction value that is determined based on the signals outputted from the media sensor 21. Thus, ink may be ejected from the second nozzle group 31*b* at the ink ejection timing appropriate to variation in the actual gap in the scanning direction, whereby printing accuracy may be improved.

The media sensor 21 is disposed next to the second nozzle groups 31*b* in the scanning direction. Therefore, the gap in the scanning direction in the area, which may be opposite to the second nozzle group 31*b* and which extends in the conveyance direction, of the recording sheet P may be determined accurately.

The media sensor 21 is disposed to the left of the second nozzle groups 31*b* in the scanning direction. With this configuration, during the forward movement of the inkjet head 12, the media sensor 21 is located ahead of the second nozzle groups 31*b* in the moving direction of the inkjet head 12. Therefore, during the forward movement of the inkjet head 12, an actual gap in a portion of a recording sheet P is determined by the media sensor 21 and the controller 50 and immediately after the actual gap is determined, ink ejection from the second nozzle group 31*b* may be performed on the portion of the recording sheet P at the ink ejection timing that is calculated based on the determined actual gap. Thus, during the forward movement of the inkjet head 12, the ink ejection timing for second nozzle group 31*b* may be accurately determined appropriate to the variation in the gap in the conveyance direction and in the scanning direction, whereby printing accuracy may be improved.

During the backward movement of the inkjet head 12, the media sensor 21 is located behind the second nozzle groups 31*b* in the moving direction of the inkjet head 12. Due to this configuration, ink ejection might not be performed at the ink ejection timing that is calculated based on the determined gap immediately after the gap is determined by the media sensor 21 and the controller 50, in a similar manner to the ink ejection manner during the forward movement of the inkjet head 12. Nevertheless, there is no great difference in shape between the corrugated shape of the recording sheet P maintained during the forward movement of the inkjet head 12 and the corrugated shape of the recording sheet P maintained during the backward movement of the inkjet head 12 performed immediately after the forward movement of the inkjet head 12. Thus, based on the gap determined based on the signals outputted from the media sensor 21 during the forward movement of the inkjet head 12, the ink ejection timing for second nozzle group 31*b* during the backward movement of the inkjet head 12 to be performed immediately after the forward movement of the inkjet head 12 is determined. Consequently, the ink ejection timing for second nozzle group 31*b* may be accurately determined appropriate to the variation in the gap in the scanning direction, whereby printing accuracy may be improved.

During the backward movement of the inkjet head 12, the ink ejection timing for second nozzle group 31*b* is determined based on the signals outputted from the media sensor 21 during the forward movement of the inkjet head 12 performed immediately prior to the backward movement of the inkjet head 12. Therefore, printing accuracy during the backward movement of the inkjet head 12 may be reduced as compared with printing accuracy during the forward movement of the inkjet head 12. Nevertheless, substantially the same corrugated shape may be formed in a portion of a recording sheet P that has not passed the corrugate plates 15 while substantially the same corrugated shape might not always be formed in the portion of the recording sheet P that has passed the corrugate plates 15. Therefore, printing is performed during both the forward and backward movements of the inkjet head 12 until the trailing edge of the recording sheet P passes the corrugate plates 15, whereby the time required for printing on a recording sheet P may be shortened while higher printing accuracy is maintained.

(2) After Trailing Edge of Recording Sheet P Passes Corrugate Plates 15

The ink ejection timing for second nozzle group 31*b* after a trailing edge of a recording sheet P in the conveyance direction passes the corrugate plates 15 is also determined based on the real-time correction value calculated based on the signals outputted from the media sensor 21 in a similar manner to determining the ink ejection timing for second nozzle group 31*b* before a trailing edge of a recording sheet P in the conveyance direction passes the corrugate plates 15.

The ink ejection timing for first nozzle group 31*a* after a trailing edge of a recording sheet P in the conveyance direction is determined using another manner that is different from determining the ink ejection timing for first nozzle group 31*a* before a trailing edge of a recording sheet P passes the corrugate plates 15. The controller 50 corrects the gap determined based on the signals outputted from the media sensor 21, using the gap correction value prestored in the controller 50, to calculate the ink ejection timing for first nozzle group 31*a* based on the corrected gap. That is, the ink ejection timing for first nozzle group 31*a* is determined based on the signals outputted from the media sensor 21.

Printing is performed on a recording sheet P by ejecting ink from the first nozzle group 31*a* and the second nozzle group 31*b*, respectively, at the respective ink ejection timings determined as described above. As described above, after the trailing edge of the recording sheet P passes the corrugate plates 15, the corrugated shape of the recording sheet P conveyed along the platen 14 changes with respect to the conveyance direction. In the illustrative embodiment, the first nozzle group 31*a* and the second nozzle group 31*b* located at the position farther from the corrugate plates 15 than the first nozzle group 31*a* eject ink therefrom at the different ejection timings, respectively. With this control, ink may be ejected from the respective nozzle of the first and second nozzle groups 31*a* and 31*b* at the respective ejection timings appropriate to the variation in the gap in the conveyance direction, whereby printing accuracy may be improved.

Substantially the same corrugated shape might not always be formed in the portion of the recording sheet P that has passed the corrugate plates 15 or the corrugated shape formed in the portion of the recording sheet P that has passed the corrugate plates 15 may change while substantially the same corrugated shape is always formed in the portion of the recording sheet P that has not passed the corrugate plates 15 or the corrugated shape formed in the portion of the recording sheet P that has not passed the corrugate plates 15 is maintained. Therefore, after the trailing edge of the recording sheet P passes the corrugate plates 15, printing is performed during the forward movement of the inkjet head 12 only, and the ink ejection timing for first nozzle group 31*a* and the ink ejection timing for second nozzle group 31*b* are determined respectively based on the signals outputted from the media sensor 21, whereby printing accuracy may be improved.

In the illustrative embodiment, the ink ejection timing for first nozzle group 31*a* is calculated based on the corrected gap that is obtained through the correction of the gap determined based on the signals outputted from the media sensor 21. Thus, the ink ejection timing for first nozzle group 31*a* may be precisely determined appropriate to the variation in the actual gap, whereby printing accuracy may be improved.

A manner of determining the ink ejection timing for first nozzle group 31*a* and the ink ejection timing for second nozzle group 31*b* when a recording sheet having relatively higher stiffness, e.g., glossy paper, is used as a recording sheet P will be described below. Table 2 shows example ink ejection timings for first nozzle group 31*a* and example ink ejection timings for second nozzle group 31*b* in this situation.

TABLE 2

| | | | First nozzle group | Second nozzle group |
|---|---|---|---|---|
| Glossy paper | Before passing corrugate plates | During forward movement | Factory correction value for first nozzle group | Factory correction value for second nozzle group |
| | | During backward movement | | |
| | After passing corrugate plates | During forward movement | Real-time correction value (Corrected) | Real-time correction value |
| | | During backward movement | Printing not performed | |

(1) Before Trailing Edge of Recording Sheet P Passes Corrugate Plates 15

The ink ejection timing for first nozzle group 31*a* and the ink ejection timing for second nozzle group 31*b* before a trailing edge of a recording sheet P in the conveyance direction passes the corrugate plates 15 are determined as the factory correction values for the first nozzle group 31*a* and the second nozzle group 31*b*, respectively, prestored in the controller 50. Therefore, the ink ejection timing for first nozzle group 31*a* and the ink ejection timing for second nozzle group 31*b* are different from each other.

Printing is performed on a recording sheet P by ejecting ink from the first nozzle group 31*a* and the second nozzle group 31*b*, respectively, at the respective ink ejection timings determined as described above. When a recording sheet having relatively higher stiffness, e.g., glossy paper, is used as a recording sheet P, not only the portion of the recording sheet P relatively closer to the corrugate plates 15 but also the portion of the recording sheet P relatively far from the corrugate plates 15 are formed into substantially the same corrugated shape and the formed corrugated shape is maintained. Therefore, in a case where a recording sheet having relatively higher stiffness, e.g., glossy paper, is used as a recording sheet P, higher printing accuracy may be ensured even when ink is ejected from the first nozzle group 31*a* relatively closer to the corrugate plates 15 and the second nozzle group 31*b* relatively far from the corrugate plates 15 at the respective ink ejection timings prestored in the controller 50 (e.g., the respective factory correction values). The determination of the ink ejection timings without using the signals outputted from the media sensor 21 may reduce processing load on the controller 50.

(2) After Trailing Edge of Recording Sheet P Passes Corrugate Plates 15

The ink ejection timing for first nozzle group 31*a* and the ink ejection timing for second nozzle group 31*b* after a trailing edge of a recording sheet P passes the corrugate plates 15 are determined based on the signals outputted from the media sensor 21 in a similar manner to determining the ink ejection timings when a recording sheet having relatively lower stiffness, e.g., plain paper, is used as a recording sheet P. That is, the ink ejection timing for first nozzle group 31*a* is determined as the real-time correction value determined based on the signals outputted from the media sensor 21, and the ink ejection timing for second nozzle group 31*b* is determined as the corrected value that is obtained through correction of the real-time correction value determined based on the signals outputted from the media sensor 21. Printing is thus performed on a recording sheet P by ejecting ink from the first nozzle group 31*a* and the second nozzle group 31*b*, respectively, at the respective ink ejection timings determined as described above.

The description has been made as to the cases where the recording sheet P is plain paper and where the recording sheet P is glossy paper. For example, when a recording sheet having stiffness whose degree is between the stiffness of the plain paper and the stiffness of the glossy paper, e.g., matte paper, is used as a recording sheet P, a manner of determining ink ejection timings for the matte paper may be the same as one of determining the ink ejection timings for the plain paper and determining the ink ejection timings for the glossy paper.

Hereinafter, variations of the illustrative embodiment will be described. Common parts have the same reference numerals as those of the above-described embodiment, and the detailed description of the common part is omitted. Variations described below may be implemented in appropriate combination with two or more of aspects of the disclosure according to the variations of the illustrative embodiment.

In the illustrative embodiment, after a trailing edge of a recording sheet P passes the corrugate plates 15, printing is performed during the forward movement of the inkjet head 12 only. Nevertheless, in other embodiments, for example, in non-interlaced printing, another control below may be executed instead of the control according to the above-described illustrative embodiment.

Regardless of the position of a trailing edge of a recording sheet P in the conveyance direction, when the moving direction of the inkjet head 12 in the second last one-pass printing is the forward direction, the inkjet head 12 is moved in the backward direction without ejecting ink from any nozzles 30 after the second last one-pass printing is performed, and then the last one-pass printing is performed while the inkjet head 12 is moved in the forward direction. When the moving direction of the inkjet head 12 in the second last one-pass printing is the backward direction, the last one-pass printing is performed while the inkjet head 12 is moved in the forward direction immediately after the second last one-pass printing. With this control, the last one-pass printing is reliably performed during the forward movement of the inkjet head 12. Regardless of the position the trailing edge of the recording sheet P in the conveyance direction, the ink ejection timing for first nozzle group 31*a* and the ink ejection timing for second nozzle group 31*b* in the last one-pass printing are determined in a similar manner to determining the ink ejection timing for first nozzle group 31*a* and the ink ejection timing for second nozzle group 31*b*, respectively, after a trailing edge of a recording sheet P passes the corrugate plates 15 in the above-described illustrative embodiment. As described in the illustrative embodiment, the media sensor 21 is disposed to the left of the ink ejection surface 12*a* in the scanning direction. This configuration may increase the printing accuracy during the forward movement of the inkjet head 12 as compared with the printing accuracy during the backward movement of the inkjet head 12.

There is a higher possibility that the last one-pass printing is performed on a recording sheet P having a corrugated shape that is different from the ideal shape after the trailing edge of the recording sheet P passes the corrugate plates 15. For example, in a case where printing data represents an image with a predetermined margin on a trailing edge portion of a recording sheet P, the last one-pass printing may be performed on the recording sheet P while the trailing edge of the recording sheet P is located at a position between the sheet feed roller 13 and the corrugate plates 15 in the conveyance direction. In this case, there may be a higher possibility that the corrugated shape formed in the recording sheet P may become irregular as compared with a case where the recording sheet P is pinched by the sheet feed roller 13. Therefore, the last one-pass printing is performed during the forward movement of the inkjet head 12 at all times regardless of the position of the trailing edge of the recording sheet P in the conveyance direction, whereby printing accuracy may be improved.

2] In non-interlaced printing, a control described below may be executed instead of the control in which printing is performed during the forward movement of the inkjet head 12 only after the trailing edge of the recording sheet P passes the corrugate plates 15.

When a total number of one-pass printing to be performed on a recording sheet P is an even number, the inkjet head 12 is moved in the forward direction from the standby position without ejecting ink therefrom and then a first one-pass printing is performed while the inkjet head 12 is moved in the backward direction. When the total number of one-pass printing to be performed on the recording sheet P is an odd number, a first one-pass printing is performed while the inkjet head 12 is moved in the forward direction from the standby position. After the first one-pass printing, subsequent one-pass printing is repeatedly and alternately performed during both the forward and backward movements of the inkjet head 12 until the last one-pass printing is performed. With this control, the last one-pass printing may always be performed while the inkjet head 12 is moved in the forward direction. The ink ejection timing for first nozzle group 31*a* and the ink ejection timing for second nozzle group 31*b* in the last one-pass printing may be determined in the similar manner to determining the ink ejection timing for first nozzle group 31*a* and the ink ejection timing for second nozzle group 31*b* after a trailing edge of a recording sheet P passes the corrugate plates 15 in the illustrative embodiment, regardless of the position of the trailing edge of the recording sheet P in the conveyance direction. Nevertheless, in other embodiments, for example, only when the trailing edge of the recording sheet P is positioned under the corrugate plates 15, the ink ejection timing for first nozzle group 31*a* and the ink ejection timing for second nozzle group 31*b* in the last one-pass printing may be determined in a similar manner to the manner of determining the ink ejection timing for first nozzle group 31*a* and the ink ejection timing for second nozzle group 31*b*, respectively, after a trailing edge of a recording sheet P passes the corrugate plates 15 in the illustrative embodiment. As described in the illustrative embodiment, the media sensor 21 is disposed to the left of the ink ejection surface 12*a* in the scanning direction. With this configuration, the printing accuracy during the forward movement of the inkjet head 12 may be increased as compared with the printing accuracy during the backward movement of the inkjet head 12. There is a higher possibility that the last one-pass printing is performed after the trailing edge of the recording sheet P passes the corrugate plates 15, that is, after the corrugated shape formed in the recording sheet P becomes irregular. Therefore, the last one-pass printing is reliably performed during the forward movement of the inkjet head 12, whereby printing accuracy may be improved.

3] In the above-described embodiment, the plurality of nozzles 30 are divided into the two nozzle groups 31*a* and 31*b* in each of the nozzle rows 31 and the ink ejection timings for the respective nozzle groups 31*a* and 31*b* are differentiated from each other. Nevertheless, in other embodiments, for example, the plurality of nozzles 30 may be divided into three or more nozzle groups in each of the nozzle rows 31 and ink ejection timings for the three or more nozzle groups are differentiated from each other.

Hereinafter, an example of determining ink ejection timings when the plurality of nozzles 30 are divided into four nozzle groups 131*a*, 131*b*, 131*c*, and 131*d* in each of the nozzle rows 31 (see FIG. 8) will be described. The four nozzle groups 131*a*, 131*b*, 131*c*, and 131*d* are arranged in order of the first nozzle group 131*a*, the third nozzle group 131*c*, the fourth nozzle group 131*d*, and the second nozzle group 131*b* from the closest to the farthest from the corrugate plates 15. The media sensor 21 is disposed to the left of and next to the second nozzle groups 131*b* in the scanning direction.

Similar to the illustrative embodiment, printing is performed on a recording sheet P during both the forward and backward movements of the inkjet head 12 until a trailing edge of the recording sheet P passes the corrugate plates 15, and printing is performed on the recording sheet P during the forward movement of the inkjet head 12 only after the trailing edge of the recording sheet P passes the corrugate plates 15.

In this case, different manners of determining ink ejection timings for the four nozzle groups 131*a*, 131*b*, 131*c*, and 131*d* to be applied until the trailing edge of the recording sheet P passes the corrugate plates 15 may be adopted depending on whether a difference between the factory correction value for first nozzle group 131*a* prestored in the controller 50 and the real-time correction value for second nozzle group 131*b* determined based on the signals outputted from the media sensor 21 is greater than or equal to a predetermined value.

When the difference is greater than or equal to the predetermined value, the ink ejection timing for first nozzle group 131*a* is determined as the factory correction value for first nozzle group 131*a* prestored in the controller 50, and the ink ejection timing for second nozzle group 131*b* is determined as the real-time correction value determined based on the signals outputted from the media sensor 21. The ink ejection timing for third nozzle group 131*c* and the ink ejection timing for fourth nozzle group 131*d* are determined based on the factory correction value for first nozzle group 131*a* and the real-time correction value for second nozzle group 131*b*. More specifically, the ink ejection timing for third nozzle group 131*c* and the ink ejection timing for fourth nozzle group 131*d* (e.g., delays from the reference ejection timing) are determined as a value between the factory correction value for first nozzle group 131*a* and the real-time correction value for second nozzle group 131*b*, and the ink ejection timing for third nozzle group 131*c* is determined as a value that is closer to the value of the ink ejection timing for first nozzle group 131*a* than the value of the ink ejection timing for fourth nozzle group 131*d*.

When the difference is smaller than the predetermined value, the ink ejection timing for first nozzle group 131*a* and the ink ejection timing for second nozzle group 131*b* are determined in the similar manner to the case where the difference is greater than or equal to the predetermined value. Further, the ink ejection timing for third nozzle group 131*c* is determined as the factory correction value for first nozzle group 131*a*, and the ink ejection timing for fourth nozzle group 131*d* is determined as the real-time correction value for second nozzle group 131*b*. Therefore, the ink ejection timing for first nozzle group 131*a* and the ink ejection timing for third nozzle group 131*c* are the same, and the ink ejection timing for second nozzle group 131*b* and the ink ejection timing for fourth nozzle group 131*d* are also the same. Thus, in each of the nozzle rows 31, practically, the plurality of nozzles 30 are divided into two large nozzle groups: one large nozzle group including the first nozzle group 131*a* and the third nozzle group 131*c* and the other large nozzle group including the fourth nozzle group 131*d* and the second nozzle group 131*b*. That is, the ink ejection timings for the two large nozzle groups are differentiated from each other.

In this variation, after the trailing edge of the recording sheet P passes the corrugate plates 15, the ink ejection timing for second nozzle group 131*b* is determined as the real-time correction value determined based on the signals outputted from the media sensor 21, and the ink ejection timing for first nozzle group 131*b*, the ink ejection timing for third nozzle group 131*c*, and the ink ejection timing for fourth nozzle group 131*d* are determined as respective corrected values that are obtained through correction of the real-time correction value for second nozzle group 131*b* using respective correction values (e.g., respective gap correction values).

In a case where a recording sheet having relatively lower stiffness, e.g., plain paper, is used as the recording sheet P, a portion of the recording sheet P relatively farther from the corrugate plates 15 may have an irregular corrugated shape. Thus, the difference between the gap in the scanning direction in the portion relatively farther from the corrugate plates 15 and the gap in the scanning direction in the portion relatively closer to the corrugate plates 15 may be considerably greater depending on the environmental conditions, such as moisture and temperature. Under this situation, if ink is ejected from the two nozzle groups 31*a* and 31*b*, respectively, ink droplets ejected from the first nozzle group 31*a* may land on respective target positions but ink droplets ejected from the second nozzle group 31*b* may land on respective positions deviated from the respective target positions, whereby printing accuracy may be decreased. In the variation, in a case where a straight line is printed by ejecting ink from the first and second nozzle groups 31*a* and 31*b*, when the difference between the factory correction value for first nozzle group 131*a* and the real-time correction value for second nozzle group 131*b* is greater than or equal to the predetermined value and the gap in the conveyance direction varies greatly, a line printed using the second nozzle group 31*b* may be improperly positioned and thus a line printed using the first nozzle group 31*a* might not connect with the line printed using the second nozzle group 31*b* and separate lines are printed. Therefore, in such a case, the nozzles 30 are divided into the four nozzle groups 131*a*, 131*b*, 131*c*, and 131*d* in each of the nozzle rows 31 and the ink ejection timings for nozzle groups 131*a*, 131*b*, 131*c*, and 131*d* are differentiated from each other such that the difference in the correction values of adjacent ones of the nozzle groups 131*a*, 131*b*, 131*c*, and 131*d* becomes less than the predetermined value. This control may enable improvement of printing accuracy.

4] In the illustrative embodiment, when plain paper is used as a recording sheet P, the ink ejection timing for second nozzle group 31*b* during the backward movement of the inkjet head 12 before the trailing edge of the recording sheet P passes the corrugate plates 15 is determined based on the signals outputted from the media sensor 21 during the forward movement of the inkjet head 12 performed immediately prior to the backward movement of the inkjet head 12. Nevertheless, in other embodiments, for example, the ink ejection timing for second nozzle group 31*b* during the backward movement of the inkjet head 12 may be determined as the factory correction value for second nozzle group 31*b* prestored in the controller 50. In this case, for a recording sheet P having relatively lower stiffness, e.g., plain paper, the factory correction value for second nozzle group 31*b* needs to be prestored in the controller 50.

5] In the illustrative embodiment, after the trailing edge of the recording sheet P passes the corrugate plates 15, the ink ejection timing for first nozzle group 31*a* is determined as the corrected value that is obtained through the correction of the real-time correction value determined based on the signals outputted from the media sensor 21. Nevertheless, in other embodiments, for example, the ink ejection timing for first nozzle group 31*a* may be determined as the real-time correction value that is not corrected. That is, after the trailing edge of the recording sheet P passes the corrugate plates 15, the ink ejection timing for first nozzle group 31*a* may be determined as the same as the ink ejection timing for second nozzle group 31*b*.

6] In the illustrative embodiment, after the trailing edge of the recording sheet P passes the corrugate plates 15, printing is performed during the forward movement of the inkjet head 12 only. Nevertheless, in other embodiments, for example, printing may be performed during both the forward and backward movements of the inkjet head. In this case, the ink ejection timing for second nozzle group 31*b* during the backward movement of the inkjet head 12 after the trailing edge of the recording sheet P passes the corrugate plates 15 may be determined based on the signals outputted from the media sensor 21 during the backward movement of the inkjet head 12. In still other embodiments, for example, the ink ejection timing for first nozzle group 31*a* during the backward movement of the inkjet head 12 after the trailing edge of the recording sheet P passes the corrugate plates 15 may be determined as the corrected value obtained through the correction of the real-time correction value calculated based on the signals outputted from the media sensor 21 during the backward movement of the inkjet head 12 or as the factory correction value prestored in the controller 50.

7] In the illustrative embodiment, the media sensor 21 is disposed to the left of the second nozzle groups 31*b* in the scanning direction only. Nevertheless, in other embodiments, for example, the media sensor 21 may be disposed to the right of the second nozzle groups 31*b* only. In this case, the printing control during the forward movement of the inkjet head 12 and the printing control during the backward movement of the inkjet head 12 performed in the illustrative embodiment may be performed reversely.

Figure 9A:
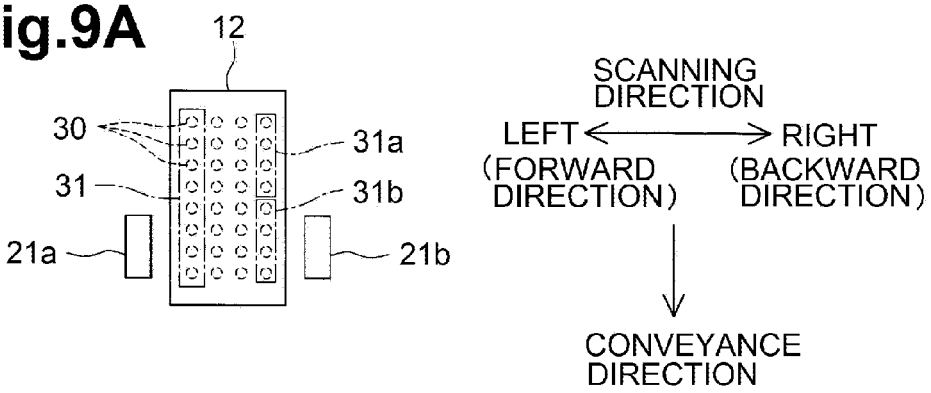
FIGS. 9A, 9B, 9C, and 9D are plan views depicting the inkjet head and a plurality of media sensors disposed in the inkjet printer in other illustrative embodiment according to one or more aspects of the disclosure.

As depicted in FIG. 9A, for example, two media sensors 21*a* and 21*b* may be disposed on opposite sides of the second nozzle groups 31*b* in the scanning direction. Table 3 shows example ink ejection timings for first nozzle group 31*a* and example ink ejection timings for second nozzle group 31*b* when plain paper is used as a recording sheet P in a variation of FIG. 9A. In Tables 3, 4, 5, and 6, contents that are different from the contents in Tables 1 and 2 according to the illustrative embodiment are indicated in bold type. In this variation, printing may be performed during both the forward and backward movements of the inkjet head 12. Regardless of the position of the trailing edge of the recording sheet P in the conveyance direction, the ink ejection timing for second nozzle group 31*b* during the backward movement of the inkjet head 12 may be determined based on the gap detection signals outputted from the media sensor 21*b*, which is disposed to the right of the inkjet head 12 in the scanning direction, during the backward movement of the inkjet head 12. The ink ejection timing for first nozzle group 31*a* during the backward movement of the inkjet head 12 after the trailing edge of the recording sheet P passes the corrugate plates 15 may be determined based on a corrected gap that is obtained through the correction of the gap information that is calculated based on the signals outputted from the media sensor 21*b* during the backward movement of the inkjet head 12. In Table 3, the ink ejection timings other than the above-described ejection timings are the same as the ink ejection timings according to the illustrative embodiment (see Table 1).

TABLE 3

| | | | First nozzle group | Second nozzle group |
|---|---|---|---|---|
| Plain paper | Before passing corrugate plates | During forward movement | Factory correction value for first nozzle group | Real-time correction value |
| | | During backward movement | | **Real-time correction value** |
| | After passing corrugate plates | During forward movement | Real-time correction value (Corrected) | Real-time correction value |
| | | During backward movement | **Real-time correction value (Corrected)** | **Real-time correction value** |

Figure 9B:
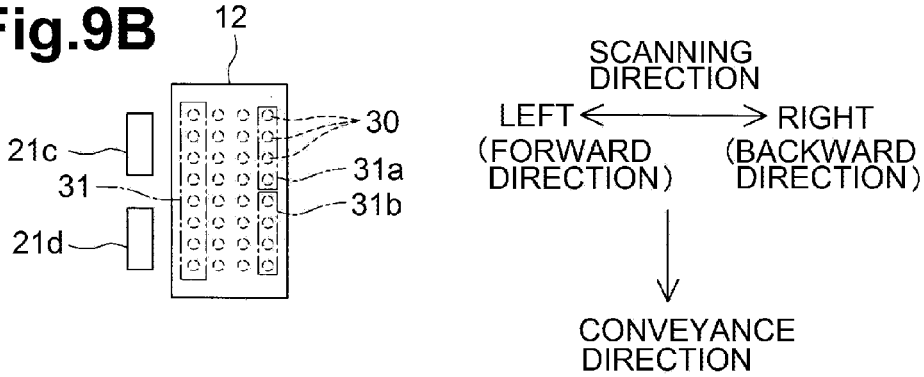

9] In another variation, as depicted in FIG. 9B, for example, a media sensor 21*c* may be disposed next to the first nozzle groups 31*a* in the scanning direction and a media sensor 21*d* may be disposed next to the second nozzle groups 31*b* in the scanning direction. In FIG. 9B, the media sensors 21*c* and 21*d* are disposed to the left of the inkjet head 12 in the scanning direction. Table 4 shows example ink ejection timings for first nozzle group 31*a* and example ink ejection timings for second nozzle group 31*b* when plain paper is used as a recording sheet P in a variation of FIG. 9B. In this variation, the ink ejection timing for first nozzle group 31*a* may be determined based on signals outputted from the media sensor 21*c* that is disposed next to the first nozzle groups 31*a* in the scanning direction. In Table 4, the ejection timings other than the above-described ejection timings are the same as the ink ejection timings according to the illustrative embodiment (see Table 1). The ink ejection timing for first nozzle group 31*a* before a trailing edge of a recording sheet P passes the corrugate plates 15 may be determined as the factory correction value prestored in the controller 50, as with the case of the illustrative embodiment.

TABLE 4

| | | | First nozzle group | Second nozzle group |
|---|---|---|---|---|
| Plain paper | Before passing corrugate plates | During forward movement | **Real-time correction value** | Real-time correction value |
| | | During backward movement | **Real-time correction value for backward movement** | Real-time correction value for backward movement |
| | After passing corrugate plates | During forward movement | **Real-time correction value (Corrected)** | Real-time correction value |
| | | During backward movement | Printing not performed | |

Figure 9C:
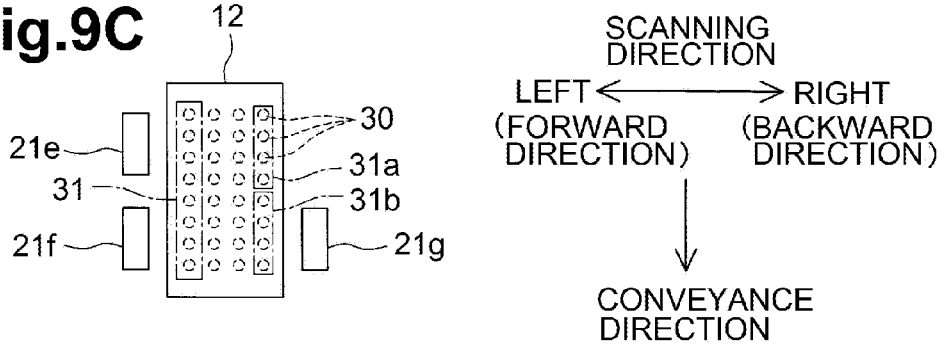

10] In other embodiments, for example, as depicted in FIG. 9C, for example, one of three media sensors 21*e*, 21*f*, and 21*g* may be disposed to one of the right and left of the first nozzle groups 31*a* in the scanning direction and the remainder of the media sensors 21*e*, 21*f*, and 21*g* may be disposed to both the right and left of the second nozzle groups 31*b* in the scanning direction. In FIG. 9C, the media sensor 21*e* may be disposed to the left of the first nozzle groups 31*a* in the scanning direction. Table 5 shows example ink ejection timings for first nozzle group 31*a* and example ink ejection timings for second nozzle group 31*b* when plain paper is used as a recording sheet P in the variation of FIG. 9C. Contents of Table 5 will be described mainly with different points from the contents of Tables 1, 3, and 4. The ink ejection timing for first nozzle group 31*a* during the backward movement of the inkjet head 12 after a trailing edge of a recording sheet P passes the corrugate plates 15 may be determined based on signals outputted from the media sensor 21*e*, which is disposed next to the first nozzle groups 31*a* in the scanning direction, during the forward movement of the inkjet head 12 performed immediately prior to the backward movement of the inkjet head 12. The other ejection timings included in Table 5 may be the same as those included in one of Tables 1, 3, and 4.

TABLE 5

| | | | First nozzle group | Second nozzle group |
|---|---|---|---|---|
| Plain paper | Before passing corrugate plates | During forward movement | **Real-time correction value** | Real-time correction value |
| | | During backward movement | **Real-time correction value for backward movement** | **Real-time correction value** |
| | After passing corrugate plates | During forward movement | **Real-time correction value** | Real-time correction value |
| | | During backward movement | **Real-time correction value for backward movement** | **Real-time correction value** |

Figure 9D:
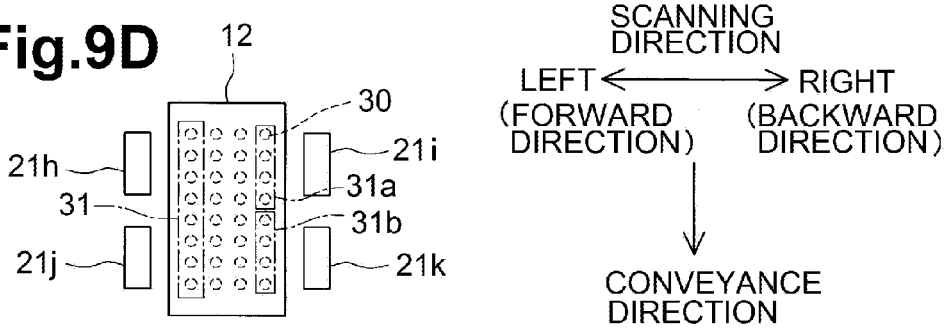

In other embodiments, for example, as depicted in FIG. 9D, for example, two of four media sensors 21*h*, 21*i*, 21*j*, and 21*k* may be disposed on opposite sides of the first nozzle groups 31*a* in the scanning direction and the remainder of the media sensors 21*h*, 21*i*, 21*j*, and 21*k* may be disposed on opposite sides of the second nozzle groups 31*b* in the scanning direction. Table 6 shows example timings of ejecting ink from the nozzles 30 when the recording sheet P is plain paper in the variation of FIG. 9D. Contents of Table 6 will be described mainly with different points from the contents of Table 5. The ink ejection timing for first nozzle group 31*a* during the backward movement of the inkjet head 12 may be determined based on signals outputted from the media sensor 21*i*, which is disposed ahead of the first nozzle groups 31*a* in the moving direction of the inkjet head 12, during the backward direction. The other ejection timings included in Table 6 may be the same as those included in Table 5.

TABLE 6

| | | | First nozzle group | Second nozzle group |
|---|---|---|---|---|
| Plain paper | Before passing corrugate plates | During forward movement | **Real-time correction value** | Real-time correction value |
| | | During backward movement | **Real-time correction value** | **Real-time correction value** |
| | After passing corrugate plates | During forward movement | **Real-time correction value** | Real-time correction value |
| | | During backward movement | **Real-time correction value** | **Real-time correction value** |

In the example variations of FIGS. 9A, 9B, 9C, and 9D, when glossy paper is used as a recording sheet P, the ink ejection timing for first nozzle group 31*a* and the ink ejection timing for second nozzle group 31*b* before a trailing edge of a recording sheet P passes the corrugate plates 15 may be determined as the respective ejection timings (e.g., the respective factory correction values) prestored in the controller 50, similar to the illustrative embodiment. Nevertheless, in other embodiments, for example, the ink ejection timing for first nozzle group 31*a* and the ink ejection timing for second nozzle group 31*b* before a trailing edge of a recording sheet P passes the corrugate plates 15 may be determined in a similar manner to the manner of determining the ink ejection timing for first nozzle group 31*a* and the ink ejection timing for second nozzle group 31*b* when plain paper is used as a recording sheet P. The ink ejection timing for first nozzle group 31*a* and the ink ejection timing for second nozzle group 31*b* after a trailing edge of a recording sheet P passes the corrugate plates 15 may be determined as the same as the ink ejection timing for first nozzle group 31*a* and the ink ejection timing for second nozzle group 31*b* after a trailing edge of a recording sheet P passes the corrugate plates 15 when plain paper is used as a recording sheet P.

Figure 8:
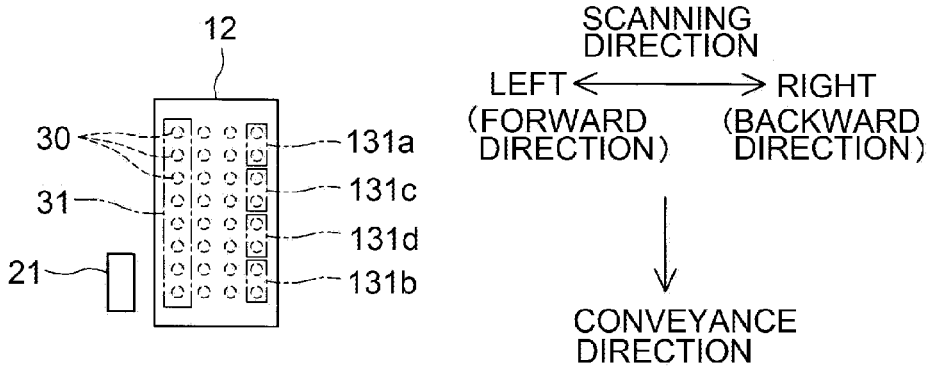
FIG. 8 is a plan view depicting the inkjet head and media sensors disposed in the inkjet printer in another illustrative embodiment according to one or more aspects of the disclosure.

In other embodiments, for example, as depicted in FIG. 8, in a case where the nozzles 30 are divided into three or more nozzle groups in each of the nozzle rows 31 and ejection timings for the three or more nozzle groups are differentiated from each other, two or more media sensors 21 may be disposed such that two or more media sensors 21 are located next to and downstream from two or more of the three or more nozzle groups in the conveyance direction, respectively. In this case, the manner of determining ink ejection timing for nozzle group that is located next to the media sensor 21 may be the same as the manner of determining the ink ejection timing for second nozzle group 31*b* according to the illustrative embodiment.

As depicted in FIGS. 9A, 9C, and 9D, in a case where two media sensors (e.g., the media sensors 21*a* and 21*b*, the media sensors 21*f* and 21*g*, the media sensors 21*h* and 21*i*, or the media sensors 21*j* and 21*k*) are disposed on opposite sides of the inkjet head 12 in the scanning direction, it may be preferable that the two media sensors are located at respective different position in the up-down direction such that the media sensors are spaced apart from each other by a predetermined distance and calibration is performed in order to obtain output difference between the media sensors. Output transmitted to the controller 50 from a light-receiving device of the media sensor upon receipt of reflected light by the light-receiving device varies depending on the number of the media sensors used and/or the paper type of the recording sheet P (e.g., reflectivity of sheet surface). Therefore, the gap in the scanning direction in a certain portion of the recording sheet P is determined using the two media sensors disposed at the respective different positions in the up-down direction. Based on the determined gap, an output difference between a signal transmitted to the controller 50 from one of the two media sensors and a signal transmitted to the controller 50 from the other of the two media sensors and difference in position in the up-down direction between the two media sensors, outputs from the media sensors per unit distance in the up-down direction may be obtained. Thus, change in outputs from the media sensors caused by age deterioration and/or the paper type of a recording sheet P may be obtained.

As depicted in FIGS. 9B, 9C, and 9D, in a case where at least one of the media sensors 21*c*, 21*e*, 21*h*, and 21*i* is disposed next to the first nozzle groups 31*a* in the scanning direction, the factory gap variation information prestored in the control device 50 may be gap information determined based on the signals determined by the at least one of the media sensors 21*c*, 21*e*, 21*h*, and 21*i* that is disposed next to the first nozzle groups 31*a* in the scanning direction, during the manufacturing stage of the inkjet printer 1. In other embodiments, for example, data to be used for calculation of gap information based on the signals outputted from the media sensors 21*c*, 21*e*, 21*h*, and 21*i* may be stored in the controller 50. In a case where the data to be used for calculation of gap information is prestored in the controller 50, a real-time correction value may be determined through comparison between the prestored data and signals outputted from the media sensors 21*c*, 21*e*, 21*h*, and 21*i* during printing.

The inkjet printer 1 according to the illustrative embodiment is configured to perform bidirectional printing. Nevertheless, the aspects of the disclosure may be applied to an inkjet printer that is configured to perform one-directional printing. In one-directional printing, printing may be performed on a recording sheet P by ejecting ink from the first nozzle group 31*a* and the second nozzle group 31*b* during the forward movement of the inkjet head 12 only. The manner of determining the ink ejection timing for first nozzle group 31*a* and the ink ejection timing for second nozzle group 31*b* may be substantially the same as the manner of determining the ink ejection timing for first nozzle group 31*a* and the ink ejection timing for second nozzle group 31*b* during forward movement of the inkjet head 12 according to the illustrative embodiment.

The inkjet printer 1 according to the illustrative embodiment is configured to print on one side of a recording sheet P. Nevertheless, in other embodiments, for example, the inkjet printer 1 may be configured to print on both sides of a recording sheet P. In this case, the recording sheet P on which printing has been performed on its one side may be conveyed again to an upstream position of the sheet feed roller 13 by a reversible roller disposed between the corrugate spurs 18 and 19 and the sheet discharge tray 4 while passing below the platen 14.

In the illustrative embodiment, the plurality of corrugate plates 15 and the overlapping portions of the ribs 16 that are located at the same position in the conveyance direction may be an example of the corrugate mechanism. The configuration of the corrugate mechanism is not limited to the above example. In other embodiments, for example, the corrugate mechanism may have another configuration if the corrugate mechanism is configured to form a predetermined corrugated shape in a recording sheet P.

In the illustrative embodiment, the corrugate plates 15 (e.g., the corrugate mechanism) are disposed upstream of the inkjet head 12 in the conveyance direction (e.g., at a position opposite to the sheet discharge tray 4). Nevertheless, in other embodiments, for example, the corrugate mechanism may be disposed both upstream and downstream of the inkjet head 12 in the conveyance direction. In other embodiments, for example, the corrugate mechanism may be disposed downstream of the inkjet head 12 in the conveyance direction only. Nevertheless, in this case, a corrugated shape may be formed in a portion of a recording sheet P that has not passed the corrugate mechanism yet. In terms of ease of forming a corrugated shape, it may be preferable that the corrugate mechanism is disposed upstream of the inkjet head 12 in the conveyance direction (e.g., at a position opposite to the sheet discharge tray 4).

In the illustrative embodiment and example variations, the aspects of the disclosure are applied to an ink ejecting device of the inkjet printer that prints, for example, an image by ejecting ink onto a recording sheet. Nevertheless, the aspects of the disclosure may be applied to other ink ejecting devices used other than printing of images. For example, the aspects of the disclosure may be applied to an ink ejecting device that may form a conductor pattern on a substrate by ejecting conductive ink.

What is claimed is:

1. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores predetermined ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, the gap sensor being disposed on one side of the liquid ejection head along the line parallel to the liquid ejection surface, wherein the plurality of nozzles include a first nozzle group and a second nozzle group disposed farther from the corrugate mechanism than the first nozzle group in the first direction, wherein the ejection timing includes a first ejection timing for ejecting liquid from the first nozzle group and a second ejection timing for ejecting liquid from the second nozzle group, and wherein the controller causes the first nozzle group to eject liquid at the first ejection timing and the second nozzle group to eject liquid at the second ejection timing different from the first ejection timing, and wherein the controller is further configured to:

determine the first ejection timing based on the predetermined ejection timing information stored in the memory;

determine the second ejection timing based on gap information relating to a gap determined by the gap sensor;

control the liquid ejection head to eject liquid from appropriate ones of the plurality of nozzles while the liquid ejection head is moved both in one direction along the line parallel to the liquid ejection surface and in a direction opposite to the one direction along the line parallel to the liquid ejection surface, wherein the one direction extends toward the one side of the liquid ejection head from another side of the liquid ejection head along the line parallel to the liquid ejection surface;

determine the second ejection timing to be used during movement of the liquid ejection head in the one direction, based on the gap information determined by the gap sensor; and determine the second ejection timing to be used during movement of the liquid ejection head in the direction opposite to the one direction, based on the gap information determined by the gap sensor while the liquid ejection head is moved in the one direction which is performed immediately prior to movement of the liquid ejection head in the direction opposite to the one direction.

2. The liquid ejection device according to claim 1, wherein the controller is further configured to:

control the liquid ejection head to eject liquid from appropriate ones of the plurality of nozzles while the liquid ejection head is moved both in the one direction and in the direction opposite to the one direction until a trailing edge of the recording medium being conveyed in the first direction by the conveyor portion passes the corrugate mechanism; and control the liquid ejection head to eject liquid from appropriate ones of the plurality of nozzles while the liquid ejection head is moved in the one direction after the trailing edge of the recording medium passes the corrugate mechanism.

3. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores predetermined ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, wherein the plurality of nozzles include a first nozzle group and a second nozzle group disposed farther from the corrugate mechanism than the first nozzle group in the first direction, wherein the ejection timing includes a first ejection timing for ejecting liquid from the first nozzle group and a second ejection timing for ejecting liquid from the second nozzle group, and wherein the controller causes the first nozzle group to eject liquid at the first ejection timing and the second nozzle group to eject liquid at the second ejection timing different from the first ejection timing, and wherein the controller is further configured to:

determine the first ejection timing based on the predetermined ejection timing information stored in the memory;

determine the second ejection timing based on gap information relating to a gap determined by the gap sensor;

perform a plurality of times of one-pass printing for printing an image on the recording medium, wherein the one-pass printing includes liquid ejection from appropriate ones of the plurality of nozzles while the liquid ejection head is moved in one of one direction and the direction opposite to the one direction;

control the liquid ejection head to eject liquid from appropriate ones of the plurality of nozzles while the liquid ejection head is moved both in the one direction and in the direction opposite to the one direction until performance of second-last one-pass printing, which is performed immediately prior to last one-pass printing;

control the liquid ejection head to be moved in the direction opposite to the one direction and not to eject liquid from any of the plurality of nozzles after the second-last one-pass printing and before the last one-pass printing, and then perform the last one-pass printing while the liquid ejection head is moved in the one direction, when the liquid ejection head is moved in the one direction during the second-last one-pass printing; and perform the last one-pass printing while the liquid ejection head is moved in the one direction after the second-last one-pass printing, when the liquid ejection head is moved in the direction opposite to the one direction during the second-last one-pass printing.

4. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, wherein the plurality of nozzles includes a first nozzle group and a second nozzle group disposed farther from the corrugate mechanism than the first nozzle group in the first direction, wherein the ejection timing includes a first ejection timing for ejecting liquid from the first nozzle group and a second ejection timing for ejecting liquid from the second nozzle group, and wherein the controller causes the first nozzle group to eject liquid at the first ejection timing and the second nozzle group to eject liquid at the second ejection timing different from the first ejection timing, wherein the liquid ejection head is further configured to be moved within a movable range including a standby position for the liquid ejection head, wherein the standby position is defined along the line parallel to the liquid ejection surface, and wherein the controller is further configured to:

determine the first ejection timing based on the predetermined ejection timing information stored in the memory;

determine the second ejection timing based on gap information relating to a gap determined by the gap sensor;

determine whether a total number of times that one-pass printing is performed on the recording medium is an even number or an odd number;

perform a plurality of times of one-pass printing for printing an image on the recording medium, wherein the one-pass printing includes liquid ejection from appropriate ones of the plurality of nozzles while the liquid ejection head is moved in one of one direction and the direction opposite to the one direction;

control the liquid ejection head to be moved from the standby position in the one direction and not to eject liquid from any of the plurality of nozzles, and subsequently perform first one-pass printing while the liquid ejection head is moved in the direction opposite to the one direction, when the total number of times that one-pass printing is performed on the recording medium is an even number;

control the liquid ejection head to eject liquid from appropriate ones of the plurality of nozzles while the liquid ejection head is moved from the standby position in the one direction, when the total number of times that one-pass printing is performed on the recording medium is an odd number; and alternate performance of one-pass printing while the liquid ejection head is moved in the one direction and one-pass printing performed while the liquid ejection head is moved in the direction opposite to the one direction after the first one-pass printing and before last one-pass printing.

5. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores predetermined ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, wherein the plurality of nozzles further includes a first nozzle group, a second nozzle group disposed farther from the corrugate mechanism than the first nozzle group in the first direction, and a third nozzle group including the plurality of nozzles disposed farther from the corrugate mechanism than the first nozzle group in the first direction and nearer to the corrugate mechanism than the second nozzle group in the first direction, wherein the ejection timing includes a first ejection timing for ejecting liquid from the first nozzle group, a second ejection timing for ejecting liquid from the second nozzle group, and a third ejection timing for ejecting liquid from the third nozzle group, wherein the controller causes the first nozzle group to eject liquid at the first ejection timing and the second nozzle group to eject liquid at the second ejection timing different from the first ejection timing, and wherein the controller is further configured to:

determine the first ejection timing based on the predetermined ejection timing information stored in the memory;

determine the second ejection timing based on gap information relating to a gap determined by the gap sensor;

assign a first subset of the plurality of nozzles as the first nozzle group and a second subset of the plurality of nozzles as the second nozzle group, and determine the first ejection timing based on the ejection timing information and the second ejection timing based on the gap information, when a difference between a first ejection timing value relating to the first ejection timing based on the ejection timing information and a second ejection timing value relating to the second ejection timing based on the gap information is smaller than a predetermined value; and assign the first subset of the plurality of nozzles as the first nozzle group, the second subset of the plurality of nozzles as the second nozzle group, and a third subset of the plurality of nozzles as the third nozzle group, and determine the first ejection timing based on the ejection timing information, the second ejection timing based on the gap information, and the third ejection timing based on the ejection timing information and the gap information, when the difference between the first ejection timing value and the second ejection timing value is greater than or equal to the predetermined value.

6. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, the gap sensor being disposed on one side of the liquid ejection head along the line parallel to the liquid ejection surface, wherein the plurality of nozzles include a first nozzle group and a second nozzle group disposed farther from the corrugate mechanism than the first nozzle group in the first direction, wherein the ejection timing includes a first ejection timing for ejecting liquid from the first nozzle group and a second ejection timing for ejecting liquid from the second nozzle group, and wherein the controller causes the first nozzle group to eject liquid at the first ejection timing and the second nozzle group to eject liquid at the second ejection timing different from the first ejection timing, wherein the controller is further configured to:

determine the first ejection timing based on the ejection timing information stored in the memory before a trailing edge of the recording medium being conveyed in the first direction by the conveyance portion passes the corrugate mechanism;

determine the first ejection timing based on gap information determined by the gap sensor after the trailing edge of the recording medium being conveyed in the first direction by the conveyor portion passes the corrugate mechanism;

determine the second ejection timing based on the gap information relating to the gap determined by the gap sensor;

control the liquid ejection head to eject liquid from appropriate ones of the plurality of nozzles while the liquid ejection head is moved both in one direction along the line parallel to the liquid ejection surface and in a direction opposite to the one direction along the line parallel to the liquid ejection surface, wherein the one direction extends toward the one side of the liquid ejection head from another side of the liquid ejection head along the line parallel to the liquid ejection surface;

determine the second ejection timing to be used during movement of the liquid ejection head in the one direction, based on the gap information determined by the gap sensor; and determine the second ejection timing to be used during movement of the liquid ejection head in the direction opposite to the one direction, based on the gap information determined by the gap sensor while the liquid ejection head is moved in the one direction which is performed immediately prior to movement of the liquid ejection head in the direction opposite to the one direction.

7. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores predetermined ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, wherein the plurality of nozzles includes a first nozzle group, a second nozzle group disposed farther from the corrugate mechanism than the first nozzle group in the first direction, and a third nozzle group including the plurality of nozzles disposed farther from the corrugate mechanism than the first nozzle group in the first direction and nearer to the corrugate mechanism than the second nozzle group in the first direction, wherein the ejection timing includes a first ejection timing for ejecting liquid from the first nozzle group, a second ejection timing for ejecting liquid from the second nozzle group, and a third ejection timing for ejecting liquid from the third nozzle group, wherein the controller causes the first nozzle group to eject liquid at the first ejection timing and the second nozzle group to eject liquid at the second ejection timing different from the first ejection timing, and wherein the controller is further configured to:

determine the first ejection timing based on the ejection timing information stored in the memory before a trailing edge of the recording medium being conveyed in the first direction by the conveyance portion passes the corrugate mechanism;

determine the first ejection timing based on gap information determined by the gap sensor after the trailing edge of the recording medium being conveyed in the first direction by the conveyor portion passes the corrugate mechanism;

determine the second ejection timing based on the gap information relating to the gap determined by the gap sensor;

assign a first subset of the plurality of nozzles as the first nozzle group and a second subset of the plurality of nozzles as the second nozzle group, and determine the first ejection timing based on the ejection timing information and the second ejection timing based on the gap information, when a difference between a first ejection timing value relating to the first ejection timing based on the ejection timing information and a second ejection timing value relating to the second ejection timing based on the gap information is smaller than a predetermined value; and assign the first subset of the plurality of nozzles as the first nozzle group, the second subset of the plurality of nozzles as the second nozzle group, and a third subset of the plurality of nozzles as the third nozzle group, and determine the first ejection timing based on the ejection timing information, the second ejection timing based on the gap information, and the third ejection timing based on the ejection timing information and the gap information, when the difference between the first ejection timing value and the second ejection timing value is greater than or equal to the predetermined value.

8. A liquid ejection device for ejecting liquid toward a recording medium, the liquid ejection device comprising:

a liquid ejection head including a liquid ejection surface formed with a plurality of nozzles, wherein the plurality of nozzles are arranged in a first direction, each of the plurality of nozzles configured to eject liquid;

a head moving unit configured to reciprocate the liquid ejection head along a line parallel to the liquid ejection surface and perpendicular to the first direction;

a conveyor portion configured to convey the recording medium in the first direction with respect to the liquid ejection head;

a corrugate mechanism disposed one of upstream and downstream of the liquid ejection head in the first direction and configured to form the recording medium in a predetermined corrugated shape having a top portion located nearest to the liquid ejection surface in a second direction orthogonal to the first direction and the line parallel to the liquid ejection surface and a bottom portion located farthest from the liquid ejection surface in the second direction, wherein the top portion and the bottom portion are arranged along the line parallel to the liquid ejection surface; and a controller configured to determine an ejection timing for ejecting liquid from ones of the plurality of nozzles appropriate to a corrugated shape formed in the recording medium by the corrugate mechanism while the liquid ejection head is moved along the line parallel to the liquid ejection surface;

a memory that stores predetermined ejection timing information related to the ejection timing; and a gap sensor configured to be moved along the line parallel to the liquid ejection surface with the liquid ejection head by the head moving unit and to determine a gap which is a distance between the recording medium and the liquid ejection surface in the second direction, wherein the plurality of nozzles include a first nozzle group and a second nozzle group disposed farther from the corrugate mechanism than the first nozzle group in the first direction, wherein the ejection timing includes a first ejection timing for ejecting liquid from the first nozzle group and a second ejection timing for ejecting liquid from the second nozzle group, and wherein the controller causes the first nozzle group to eject liquid at the first ejection timing and the second nozzle group to eject liquid at the second ejection timing different from the first ejection timing, wherein the controller is further configured to:

determine the second ejection timing for a second period during which the recording medium is conveyed, based on the predetermined ejecting timing information stored in the memory and gap information relating to the gap determined by the gap sensor in real time; and determine the first ejection timing for a first period during which the recording medium is conveyed, based on the predetermined ejection timing information stored in the memory and not on gap information relating to the gap determined by the gap sensor in real time.

9. The liquid ejection device according to claim 8, wherein the first period and the second period partially overlap.

10. The liquid ejection device according to claim 8, wherein the first period and the second period are the same.

11. The liquid ejection device according to claim 8, wherein the controller is further configured to:

determine the first ejection timing for a third period during which the recording medium is conveyed, based on the gap information relating to the gap determined by the gap sensor;

control the liquid ejection head to eject liquid from appropriate ones of the plurality of nozzles while the liquid ejection head is moved both in one direction and in the direction opposite to the one direction until a trailing edge of the recording medium being conveyed in the first direction by the conveyor portion passes the corrugate mechanism during the first period; and control the liquid ejection head to eject liquid from appropriate ones of the plurality of nozzles while the liquid ejection head is moved in the one direction after the trailing edge of the recording medium passes the corrugate mechanism during the third period.

* * * * *